US005587279A

United States Patent [19]

Mifune et al.

[11] Patent Number: 5,587,279

[45] Date of Patent: Dec. 24, 1996

[54] SILVER HALIDE EMULSION AND METHOD OF PREPARING THE SAME

[75] Inventors: Hiroyuki Mifune; Junichi Yamanouchi; Shoji Ishiguro, all of Kanagawa, Japan

[73] Assignee: Fuji Photo Film Co., Ltd., Kanagawa, Japan

[21] Appl. No.: 791,402

[22] Filed: Nov. 14, 1991

[30] Foreign Application Priority Data

Nov. 14, 1990 [JP] Japan ..... 2-308062
Nov. 29, 1990 [JP] Japan ..... 2-331419

[51] Int. Cl.[6] ..... G03C 1/035

[52] U.S. Cl. ..... 430/567; 430/570

[58] Field of Search ..... 430/567, 569, 430/570, 629

[56] References Cited

U.S. PATENT DOCUMENTS 4,400,463 8/1983 Maskasky ..... 430/567

FOREIGN PATENT DOCUMENTS 1003642 1/1989 Japan ..... 430/567

OTHER PUBLICATIONS

Claes et al, *J. Photo. Science,* 21:39–50 (1973).
Japio Abstract of JP01–3642.

*Primary Examiner*—Janet C. Baxter
*Attorney, Agent, or Firm*—Sughrue, Mion, Zinn, Macpeak & Seas

[57] ABSTRACT

A silver halide photographic emulsion which comprises silver halide grains having a silver chloride content of at least 60 mol % and an octatetracontahedral crystal form of the kind which is constructed of 48 triangular faces, every one of which contacts convexly with each of its two adjoining faces to form a line and concavely with its one adjoining face to form a line, with the grains being formed in the presence of a synthetic polymer peptizer which contains, as repeating units, units derived from a thioether linkage-containing ethylenically unsaturated monomer, in a mole fraction of from about 20 to 100 mole %, thereby achieving low fog and high sensitivity.

7 Claims, 4 Drawing Sheets

SILVER HALIDE EMULSION AND METHOD OF PREPARING THE SAME

FIELD OF THE INVENTION

This invention relates to a silver halide photographic emulsion, and to a method of preparing this photographic emulsion. In particular, this invention relates to a silver halide photographic emulsion comprising silver chlorobromide, chloroiodide or chloroiodobromide grains having a high chloride content, or silver chloride grains, which has an aptitude for rapid processing, reduced fog, improved color sensitization, heightened sensitivity and so on, and to a method of preparing this photographic emulsion.

BACKGROUND OF THE INVENTION

In recent years a reduction in processing time has been desired earnestly in the photographic industry, so the development of silver halide photographic materials suitable for rapid processing has been a pressing need.

Silver halide emulsions having a high silver chloride content (which are simply abbreviated as high chloride content emulsions, hereinafter) are responsive to this need because they progress most rapidly in development of the light-sensitive silver halides.

Compared with silver halide emulsions having a high bromide content, however, high chloride content emulsions have a serious defect in that it is difficult for them to have high sensitivity because they tend to generate fog when subjected to chemical sensitization using a sulfur sensitizer, a selenium sensitizer, a gold or noble metal sensitizer, a reduction sensitizer or a mixture of two or more thereof, which is usually carried out in order to attain the desired sensitivity, the desired gradation and so on. In addition, they have other defects in that they tend to generate fog in a development-processing step, as well as upon storage, and undergo considerable deterioration in sensitivity and gradation during storage.

To prevent such phenomena, particularly the generation of fog, heterocyclic mercapto compounds called antifoggants, including 1-phenyl-5-mercaptotetrazole as a representative example, have so far been used very often. However, antifoggants of this kind adsorb so strongly to silver halide grains that they tend to adversely influence the photographic characteristics, e.g., they retard the progress of development, they lower the maximum image density, they decrease the contrast, and so on. Therefore, many restrictions exist in their use. Under these circumstances, it has been strongly desired to develop high chloride-content emulsions which have high sensitivity and, what is more, have reduced fog generation extent without using such antifoggants.

SUMMARY OF THE INVENTION

A first object of this invention is to provide a high silver chloride content emulsion having an aptitude for rapid processing.

A second object of this invention is to provide a high silver chloride content emulsion which has reduced fog density and heightened sensitivity without the accompanying disadvantages such as retarding the progress of development and lowering of the image density.

A third object of this invention is to provide a highly sensitive high silver chloride content emulsion which generates fog only to a slight extent, even though, chemical sensitization which is conducted.

A fourth object of this invention is to provide a high chloride content emulsion which is highly responsive to color sensitization.

A fifth object of this invention is to provide a method of preparing silver halide emulsions achieving the above objects of the present invention.

The above-described objects are attained with a silver halide photographic emulsion comprising silver halide grains which have a silver chloride content of at least 60 mol % and an octatetracontahedral crystal form of the kind which comprises by 48 triangular faces, every one of which contacts convexly to each of its two adjoining faces to form a line and concavely with its one adjoining face to form a line.

DETAILED DESCRIPTION OF THE INVENTION

Figure 1:
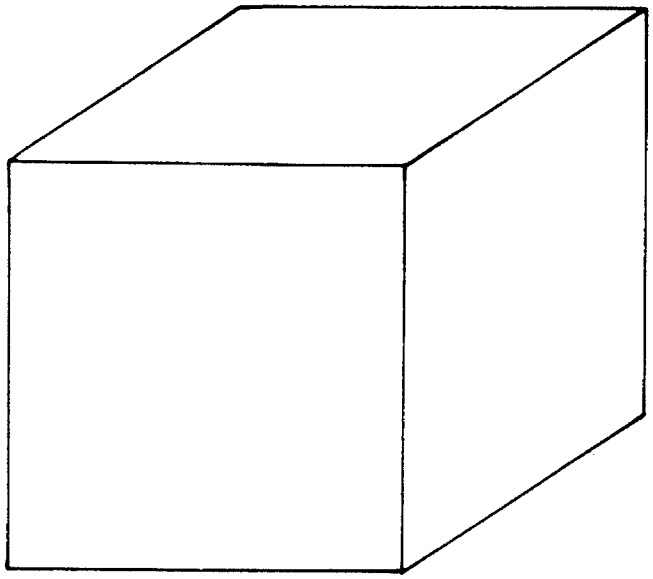
FIG. 1 depicts an ordinary cubic silver chloride type grain.

The high chloride content emulsion grains, which have a high chloride content as in this invention, generally assume the crystal form of a cube as depicted in FIG. 1.

Figure 2:
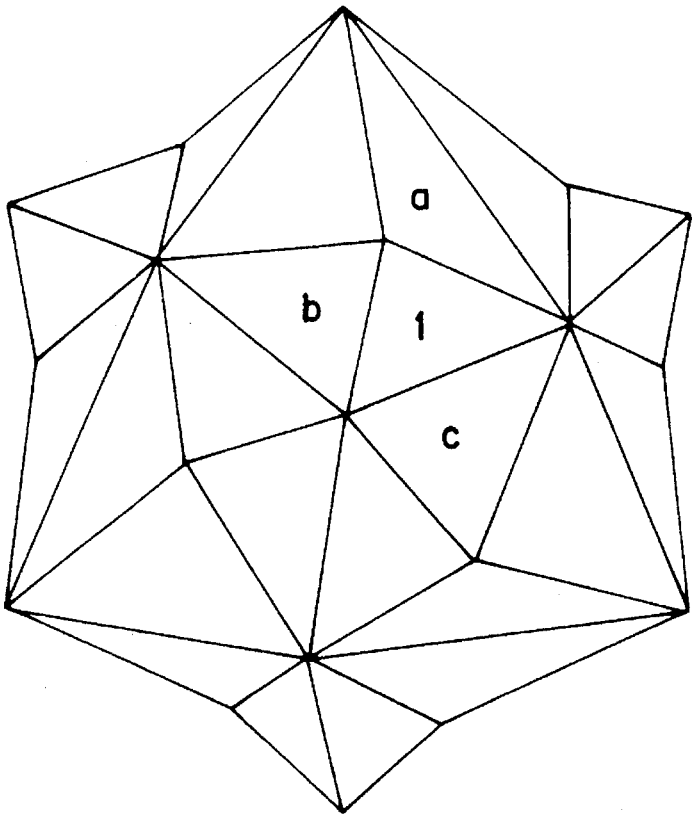
FIG. 2 depicts the octatetracontahedral silver chloride grains of this invention.

In contrast to this general situation, the grains of this invention, as illustrated in FIG. 2, assume an octatetracontahedral crystal form constructed of 48 triangular faces, every one of which contacts convexly, convexly and concavely to its three respective adjoining faces in lines (that is, the face 1 intersects concavely with the adjoining face a and convexly with each of the adjoining faces b and c, as illustrated in FIG. 2). In other words, every face is characterized as having one side which forms a concavity at the intersection with one adjoining face. The grains having the above-described crystal form, as described hereinafter in the Examples, possess markedly excellent characteristics that they only slightly give rise to fog by nature, they are hardly fogged upon chemical sensitization, high sensitivity can be achieved, and so on.

Although hexoctahedral grains constructed of 48 faces are disclosed in JP-A-62-123446 corresponding to U.S. Pat. No. 4,680,254 (The term "JP-A" as used herein means an "unexamined published Japanese patent application"), every face of the individual grains contacts convexly to each of its three adjoining faces to form a line, which is in marked contrast to the grains of this invention. As described in detail hereinafter, the grains of this invention are produced by forming the grains in the presence of a particular synthetic peptizer without using any gelatin. On the other hand, the grains disclosed in JP-A-62-123446 are prepared in the presence of gelatin using a compound generally considered an antifoggant, such as 6-nitrobenzimidazole, and low molecular weight compounds, e.g., merocyanine dyes, which have a high probability of retarding development and chemical sensitization or causing marked color stain to occur due to their strong adsorption on the individual surfaces of the silver halide grains. That is, these two kinds of silver halide grains are prepared using quite different techniques, and completely differ in appearance, too. Therefore, the silver halide grains of this novel type would not have been imagined prior to this invention.

Additionally, the grains of this invention may partly have concavities, or may assume a nonparallel twinning structure (wherein, although the number of faces is not 48, concavities are necessarily present together with convexities).

Because of the high chloride content, the individual surfaces of the grains of this invention tend to be roundish when ripening is conducted at high temperatures or other treatments, as frequently occurs with polyhedral grains. However, excellent photographic characteristics inherent in the grains of this invention are not adversely influenced by this phenomenon.

The silver halide grains of this invention can be prepared in accordance with the following method.

More specifically, the grains are prepared using a method in which a photographic silver halide emulsion comprising silver halide grains whose silver chloride content is at least 60 mole % is produced in the presence of a polymer such as synthetic peptizer which contains as repeating units forming the compound derived from a thioether linkage-containing ethylenically unsaturated monomer in a mole fraction of at least 20 mol %.

The synthetic peptizer of this invention may be a polymer formed of only thioether linkage-containing ethylenically unsaturated monomer units so long as it is soluble in water.

Thioether linkage-containing ethylenically unsaturated monomers which can be advantageously used in this invention include ethylenically unsaturated monomer units having a thioether linkage in the side chains, thereof which are represented by the following general formula (A):

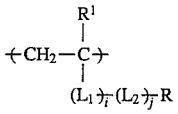

(A)

In the formula (A), $R^1$ represents a hydrogen atom, an alkyl group containing 1 to 4 carbon atoms, or a chlorine atom; $L^1$ represents

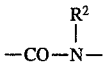

(wherein $R^2$ is a hydrogen atom, an unsubstituted alkyl group containing 1 to 4 carbon atoms, or a substituted alkyl group containing 1 to 6 carbon atoms, —COO—, —NHCO—, —OCO—,

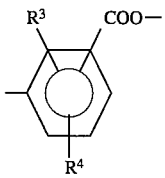

(wherein $R^3$ and $R^4$ each represent a hydrogen atom, a hydroxyl group, a halogen atom, or a substituted or unsubstituted alkyl, alkoxy, acyloxy or aryloxy group),

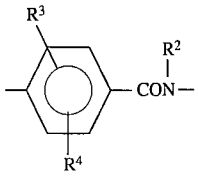

(wherein $R^2$ $R^3$ and $R^4$ have the same meanings as described above, respectively); $L^2$ represents a linkage group which necessarily contains at least one thioether moiety and connects $L^1$ to R; i represents 0 or 1; j represents 1 or 2; and R represents a monovalent substituent group. More specifically, the linkage group represented by $L_2$ has the following formula;

$$+X^1+(J^1-X^2)_p+(J^2-X^3)_q+(J^3-X^4)_r J^4+$$

wherein $J^1$, $J^2$, $J^3$ and $J^4$ may be the same or different, and each represents —S—, —CO—, —$SO_2$—,

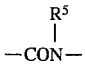

($R^5$=H, or substituted or unsubstituted alkyl group having 1 to 6 carbon atoms),

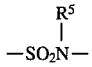

($R^5$=the same as above),

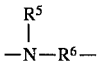

($R^5$=the same as above; $R^6$=an alkylene group having 1 to 4 carbon atoms),

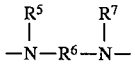

($R^5$ and $R^6$=the same as above, respectively; $R^7$=H, or a unsubstituted or substituted alkyl group having 1 to 6 carbon atoms), —O—,

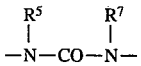

($R^5$ and $R^7$=the same as above respectively),

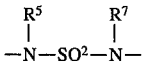

($R^5$ and $R^7$=the same as above respectively), —COO—, —OCO—,

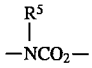

($R^5$=the same as above),

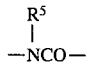

($R^5$=the same as above) and so on, provided that at least one of them is —S—.

$X^1$, $X^2$, $X^3$ and $X^4$ may be the same or different, and each represents an unsubstituted or substituted alkylene group, an unsubstituted or substituted arylene group, or an unsubstituted or substituted aralkylene group.

p, q and r each represent 0 or 1, but p, q and r are not simultaneously 0.

More specifically, $X^1$, $X^2$, $X^3$ and $X^4$ may be the same or different, and each represents an unsubstituted or substituted alkylene group containing 1 to 10 carbon atoms, an aralkylene group or a phenylene group. The alkylene group may be straight-chain or branched, and examples include methylene, methylmethylene, dimethylmethylene, dimethylene, trimethylene, tetramethylene, pentamethylene, hexamethylene and decylmethylene. Examples of the aralkylene group, include a benzylidene group. Examples of a substituted or unsubstituted phenylene group include p-phenylene,m-phenylene, methylphenylene and so on.

The alkylene, aralkylene and phenylene groups represented by $X^1$, $X^2$, $X^3$ and $X^4$ may contain as substituent group(s), one or more of a halogen atom, a nitro group, a cyano group, an unsubstituted or substituted alkyl group, an unsubstituted or substituted alkoxy group, —$NHCOR^8$ ($R^8$=a substituted or unsubstituted alkyl group, a substituted or unsubstituted phenyl group, or a substituted or unsubstituted aralkyl group), —$NHSO_2R^8$ ($R^8$=the same as above), —$SOR^8$ ($R^8$=the same as above), —$SO_2R^8$ ($R^8$=the same as above), —$COR^8$ ($R^8$=the same as above),

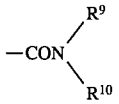

($R^9$ and $R^{10}$=the same or different, a hydrogen atom, an unsubstituted or substituted alkyl group, an unsubstituted or substituted phenyl group, or an unsubstituted or substituted aralkyl group),

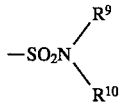

($R^9$ and $R^{10}$=the same as above, respectively), an amino group (which may be substituted by an alkyl group(s)), a hydroxyl group, or/and a group capable of forming a hydroxyl group through hydrolysis. When two or more substituent groups are present, they may be the same or different.

Examples of substituent groups for the above-described substituted alkyl, alkoxy, phenyl and aralkyl groups include a hydroxyl group, a nitro group, an alkoxy group containing 1 to about 4 carbon atoms, —$NHSO_2R^8$, —$NHCOR^8$,

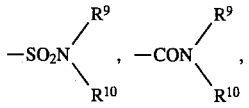

—$SO_2R^8$, —$COR^8$, a halogen atom, a cyano group, an amino group (which may be substituted by an alkyl group(s)), and so on. $R^8$, $R^9$ and $R^{10}$ have the same meanings as described above, respectively.

R in the formula (A) represents a monovalent substituent group, with examples including substituted or unsubstituted alkyl groups containing from 1 to 20 carbon atoms and substituted or unsubstituted aryl groups containing from 6 to 20 carbon atoms. Specific examples of such alkyl groups are methyl, ethyl, n-propyl, isopropyl, n-butyl, o-butyl, n-hexyl, n-octyl, n-dodecyl and so on.

Suitable substituent(s) which may be present on the foregoing alkyl and aryl groups are those described above as substituent(s) for $X^1$, $X^2$, $X^3$ and $X^4$. Specifically, examples include a halogen atom, a nitro group, a cyano group, a substituted or unsubstituted alkyl group, a substituted or unsubstituted alkoxy group, —$NHCOR^8$, —$NHSO_2R^8$, —$SOR^8$, —$SO_2R^8$, —$COR^8$,

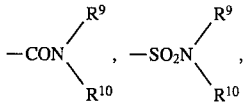

an amino groups (which may be substituted by an alkyl group(s)), a hydroxyl group, and a group capable of forming a hydroxyl group by hydrolysis. Again, $R^8$, $R^9$ and $R^{10}$ have the same meanings as described above.

Specific examples of representative ethylenically unsaturated monomers which can provide the repeating units of the general formula (A) are set forth below.

3-Thiapentylacrylate,
2-Thiabutylacrylate,
3-Thiapentylmethacrylate,
2-Thiabutylmethacrylate,
N-(3-Thiapentyl)acrylamide,
N-(3-Thiabutyl)acrylamide,
N-(3-Thiapentyl)methacrylamide,
5-Thiaheptylacrylate,
N-(7-Thiaheptyl)acrylamide,
N-(3-Thiaoctyl)acrylamide,
N-(7-Thianonyl)acrylamide,
N-(2,5-Dimethyl-4-thiahexyl)methacrylamide,
N-Acryloylmethionine,
N-Methacryloylmethionine,
N-Acryloylmethionine methyl ester,
N-(3,6-Dithiaheptyl)acrylamide,
N-[2,2-bis(1-Thiapropyl)ethyl]acrylamide,

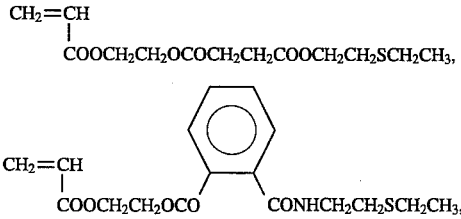

3-Thiapentyl 4-vinylbenzoate,

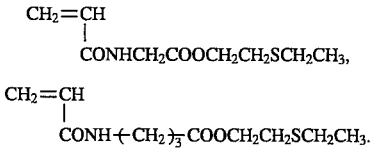

It is preferred for the polymers comprising the repeating units represented by the general formula (A) should be soluble in water. Therefore, monomers from which the foregoing repeating units are derived may be copolymerized with thioether linkage-free ethylenically unsaturated monomer(s), if needed.

Particularly preferred ethylenically unsaturated monomers copolymerizable with the monomers described above and used in this invention are those which provide homopolymers which are soluble in water, an acidic aqueous solution or an alkaline aqueous solution. Specific examples thereof include nonionic monomers, such as acrylamide, methacrylamide, N-methylacrylamide, N,N-dimethylacrylamide, N-acryloylmorpholine, N-ethylacrylamide, N-vinylpyrrolidone and so on; monomers containing an anionic

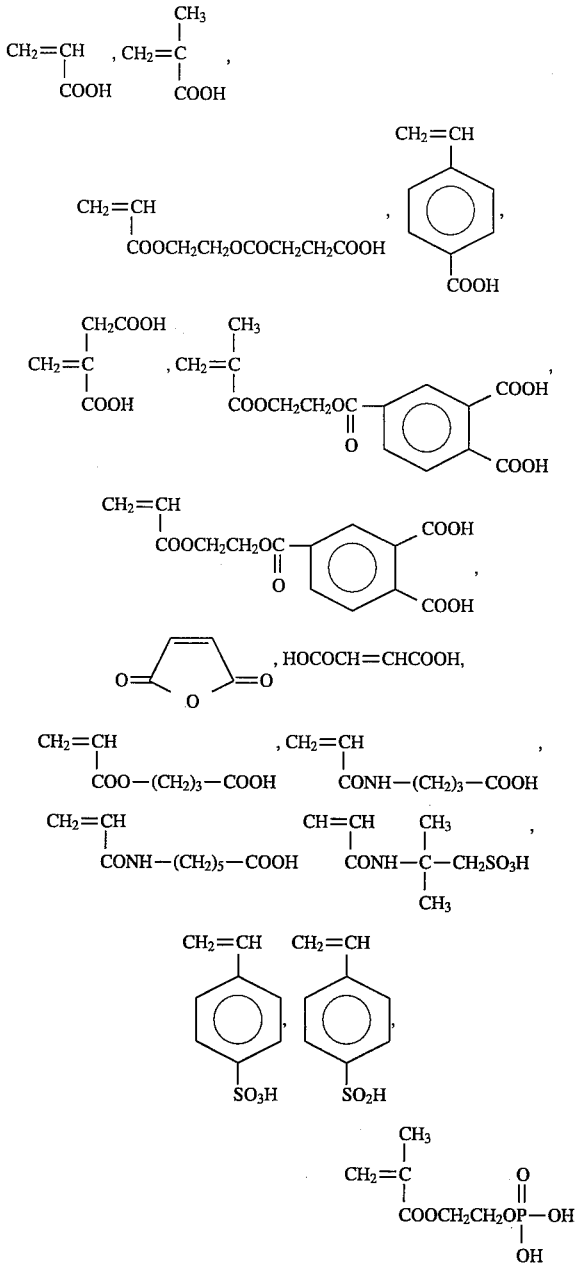

and so on, or salts of these monomers (e.g., the potassium, sodium and ammonium salts thereof); and monomers containing a cationic group, such as tertiary amines including N,N-diethylaminoethylmethacrylate, N,N-diemethylaminoethylacrylate, N,N-diethylaminoethylacrylate, N-(N,N-dimethylaminopropyl)acrylamide, N-(N,N-dihexylaminomethyl)acrylamide, 3-(4-pyridyl)propylacrylate, N,N-diethylaminomethylstyrene and the like, or the salts thereof (e.g., hydrochlorides, sulfates and acetates thereof), and quaternary ammonium compounds including N,N,N-trimethyl-N-vinylbenzylammonium chloride, N,N,N-trimethyl-N-(3-acrylamidopropyl)ammonium chloride and the like. Of these monomers, nonionic monomers and monomers containing anionic functional groups are preferred in particular.

Further, polymers comprising the repeating units of the formula (A) can contain other ethylenically unsaturated monomers as copolymerizing units, in an amount not to effect disadvantageously on a solubility in water. Suitable examples of these monomers include ethylene, propylne, 1-butene, isobutene, styrene, α-methylstyrene, vinyl ketone, monoethylenic unsaturated esters of aliphatic acids (e.g., vinyl acetate, allyl acetate), esters of ethylenically unsaturated mono- or dicarboxylic acids (e.g., methylmethacrylate, ethylmethacrylate, n-butylmethacrylate, n-hexylmethacrylate, cyclohexylmethacrylate, benzylmethacrylate, n-butylacrylate, n-hexylacrylate, 2-ethylhexylacrylate), monoethylenic unsaturated compounds (e.g., acrylonitrile), and dienes (e.g., butadiene, isoprene).

The polymer comprising the repeating units of the formula (A) contain the thioether group-containing monomer in an amount of from about 20 mol % to about 100 mol %, preferably from 25 mol % to 100 mol %, and particularly preferably from 30 mol % to 80 mol %.

The polymer comprising the repeating units of the formula (A) has a molecular weight of from about 1000 to about 200,000.

Specific examples of polymers used in this invention which comprise repeating units represented by the general formula (A) above are set forth below. However, the present invention should not be construed as being limited to these examples.

P-1 3-Thiapentylacrylate/Sodium 2-acrylamido-2-methylpropanesulfonate Copolymer (molar ratio: 1/0.8)

P-2 3-Thiapentylacrylate/Sodium 2-acrylamido-2-methylpropanesulfonate Copolymer (molar ratio: 1/1), P-3 3-Thiapentylacrylate/Sodium 2-acrylamido-2-methylpropanesulfonate Copolymer (molar ratio: 1/2), P-4 3-Thiapentylacrylate/Sodium 2-acrylamido-2-methylpropanesulfonate Copolymer (molar ratio: 1/2.5), P-5 3-Thiapentylacrylate/Sodium 2-acrylamido-2-methylpropanesulfonate Copolymer (molar ratio: 1/3), P-6 3-Thiapentylacrylate/Sodium 2-acrylamido-2-methylpropanesulfonate Copolymer (molar ratio: 1/3.5), P-7 3-Thiapentylmethacrylate/Sodium 2-acrylamido-2-methylpropanesulfonate Copolymer (molar ratio: 1/2), P-8 3-Thiapentylmethacrylate/Sodium 2-acrylamido-2-methylpropanesulfonate Copolymer (molar ratio: 1/3), P-9 2-Thiabutylacrylamide/Sodium 2-acrylamido-2-methylpropanesulfonate Copolymer (molar ratio: 1/2), P-10 3-Thiapentylacrylate/Acrylic acid/Sodium acrylate Copolymer (molar ratio: 1/1/1), P-11 3-Thiapentylacrylate/Acrylamide Copolymer (molar ratio: 1/2.5), P-12 N-(3-Thiapentyl)acrylamide/Acrylamide/Sodium acrylate Copolymer (molar ratio: 1/0.5/1), P-13 2-Thiabutylacrylate/Methylmethacrylate/Sodium 2-acrylamido-2-methylpropanesulfonate Copolymer (molar ratio: 1/0.5/1.5), P-14 N-(3-Thiabutyl)acrylamide/Sodium acrylate/Sodium styrenesulfonate (molar ratio: 1/1/1), P-15 3-Thiapentylacrylate/Methylacrylate/N,N-Dimethylaminopropylmethacrylamide sulfate Copolymer (molar ratio: 1/1/1), P-16 3-Thiapentyl-4-vinylbenzoate/N,N-Dimethylaminomethylstyrene sulfate Copolymer (molar ratio: 1/2), P-17 Sodium N-acryloylmethionine/Methylmethacrylate/2-acrylamido-2-methylpropane sulfate Copolymer (molar ratio: 1/1/1), P-18 N-Acryloylmethionine methyl ester/Sodium 2-acrylamido-2-methylpropanesulfonate (molar ratio:1/2.5), P-19 N-(3,6-Dithiaheptyl)acrylamide/Acryl amide/Sodium 2-acrylamido-2-methylpropanesulfonate Copolymer (molar ratio: 1/0.5/2), P-20 N-[2,2-Bis(1-thiapropylethyl]acrylamide/N-vinylpyrrolidone/2-Acrylamido-2-methylpropanesulfonate Copolymer (molar ratio: 1/0.25/2).

The above-cited monomers and polymers containing thioether linkage(s) are disclosed, e.g., in U.S. Pat. Nos. 3,536,677, 3,615,624, 3,679,425, 3,692,753 and 3,706,564, *Research Disclosure*, volume 104, pages 44–48 (1972), and so on. Syntheses thereof can be performed in accordance with the disclosure in the references set forth above.

The polymers of this invention can be produced using various polymerization methods, including solution polymerization, precipitation polymerization, suspension polymerization and block polymerization. The initiation of polymerization can be effected using a radical initiator, irradiating the reaction system with light or radiation, applying heat to the reaction system, and so on. These polymerization methods and initiation methods are well known and are described, e.g., in Teiji Tsuruta, *Kohbunshi Gousei Hannoh* ("Polymer Synthesizing Reactions"), revised edition, Nikkan Kogyo Shinbun-sha (1971).

A solution polymerization method utilizing a radical initiator is preferred in particular of these foregoing polymerization methods.

Solvents suitable for use in the solution polymerization method include water and various kinds of organic solvents, such as ethyl acetate, methanol, ethanol, 1-propanol, 2-propanol, acetone, dioxane, N,N-dimethylformamide, N,N-dimethylacetamide, toluene, n-hexane, acetonitrile and so on. These organic solvents may be used alone, or a mixture of two or more thereof, or a mixture with water, may be used.

The polymerization temperature is dependent on the molecular weight of the polymer to be formed, the kind of the initiator used, and so on. Although it is possible to use a polymerization temperature of below 0° C. or above 100° C., temperatures ranging from 30° C. to 100° C. are generally chosen as the polymerization temperature.

Suitable radical initiator which can be used in polymerization include azo type initiators, such as 2,2'-azobisisobutyronitrile, 2,2'-azobis(2,4-dimethyl-valeronitrile), 2,2'-azobis(2-amidinopropane)dihydrochloride, 4,4'-azobis(4-cyano-pentanoic acid), etc., and peroxide type initiators such as benzoyl peroxide, potassium persulfate, etc., are preferable.

The amount of the initiator to be used depends on the intended molecular weight of the polymer to be formed, but generally ranges preferably from about 0.01 to 10 mol %, particularly preferably from 0.01 to 1.0 mol %, per mol. of the monomer(s) used.

In synthesizing the polymer of this invention in the form of copolymer, the polymerization may be carried out by adding an initiator to a reaction vessel in which all the monomers to be used are placed in advance. However, it is preferable to synthesize the intended copolymer through the dropwise addition of the monomers to a polymerization medium.

Two or more ethylenically unsaturated monomers may be added dropwise together as a mixture, or separately. In dropwise addition, the ethylenically unsaturated monomers may be dissolved in an appropriate auxiliary solvent. Suitable auxiliary solvents are water, an organic solvent (e.g., methanol, ethanol, acetone, ethyleneacetic acid) or a mixture of water with an organic solvent may be used if desired.

The time required for dropwise addition, although it is different in terms of polymerization reactivities of the ethylenically unsaturated monomers used, ranges preferably from about 5 minutes to about 8 hours, and particularly preferably from 30 minutes to 4 hours. A dropping rate may be constant during the dropwise addition, or may be changed appropriately within the dropping time allowed. When two or more ethylenically unsaturated monomers are added dropwise separately, the total dropwise addition time and a dropwise addition rate of each monomer can be arbitrarily changed as the occasion demands. In particular, when monomers differing greatly in polymerization reactivity are used, it is desirable to use a method such that the higher is the monomer's reactivity, the more slowly it is added.

The polymerization initiator may be added in advance to a polymerization solvent, or may be added simultaneously with the ethylenically unsaturated monomer(s). Also, it may be dissolved in a solvent, and added dropwise separately from ethylenically unsaturated monomer(s). These addition techniques may be employed as a combination of two or more thereof.

The temperature at which the ethylenically unsaturated monomers is added is not limited, provided that the polymerization can be initiated at that temperature. Although the optimal temperature depends on the kind of initiator used and the kinds of ethylenically unsaturated monomers used, it ranges generally from about 20° C. to about 100° C., preferably from 30° C. to 100° C., and particularly preferably from 40° C. to 95° C.

Silver halide grain formation in the presence of a thioether linkage-containing synthetic peptizer, as employed in this invention, is already known, e.g., as disclosed in U.S. Pat. Nos. 3,536,677, 3,615,624, 3,679,425, 3,690,888, 3,692,753, 3,860,428 and 4,400,463, and *Journal of Imaging Science*, volume 31, pages 148–156 (1987).

However, although these patents disclose silver iodobromide emulsions, they rarely mention a high silver chloride-content silver halide emulsion. In addition, they do not describe the preparation of high chloride-content silver halide emulsion in the presence of thioether type synthetic peptizer high in thioether content, as embodied in this invention. Of course, no suggestion of the octatetracontahedral grains of this invention is set forth in any of these patents. Accordingly, the effects of the present invention are quite surprising since it is impossible to foresee the present invention from conventional knowledge.

The term "high silver chloride-content silver halide grains" as used in this invention is intended to include silver halide grains having a chloride content of at least 60 mol %. The chloride content in the silver halide grains of this invention, is preferably at least 80 mol %, and particularly preferably from 95 mol % to 100 mol % (namely, pure silver chloride).

Although the remaining halide may be bromide and/or iodide, it is desirable that the silver iodide content should be controlled to below about 10 mol %, preferably below 3 mol %. A layer containing bromide or iodide as main component may be localized in the vicinity of the grain surface. Also, the grains may have a so-called core/shell structure.

The amount of the thioether linkage-containing synthetic peptizer used in this invention is not particularly limited. However, it is preferably used in an amount of from 0.3 to 100 g, particularly from 1 to 80 g, per mole of silver halide.

When gelatin is present at the initial stage of grain formation, it becomes impossible to obtain the octatetracontahedral silver halide grains of this invention. However, gelatin may be present in the intermediate to the final stage of the grain formation (for example, after the addition of 50% of the silver nitrate to be used is completed).

Further, during a period from after grain formation to just before coating, gelatin can be added as a vehicle (binder) to the emulsion of this invention in order to facilitate coating on a support. A suitable amount of gelatin added therefor is at least 30 g, particularly at least 50 g, per mol. of silver halide.

Suitable vehicles usable therefor are described in *Research Disclosure*, Volume 176, Item 17643.

The grain formation in this invention can be carried out within a temperature from about 10° C. to about 95° C., preferably from 40° C. to 80° C., since the peptizer does not cause gelation to occur in contrast to gelatin.

Although any pH is allowed during the grain formation, it is desirable that the pH should be in the neutral to acidic region. In other words, a preferred pH is below 8, especially below 7. The pAg is preferably adjusted to at least 6.

The high silver chloride-content silver halide grains of this invention are not particularly restricted in terms of grain size. However, a grain size ranging from 0.05 to 10 μm, particularly from 0.1 to 3 μm, is desirable.

Cadmium salts, zinc salts, lead salts, thallium salts, iridium salts or complexes therof, rhodium salts or complexes therof, iron salts or complexes and/therof and the like may be present during the process of forming the silver halide grains or the physically ripening of the formed silver halide grains. In particular, iridium salts or rhodium salts are preferred over others.

A method in which a silver salt solution (e.g., an aqueous solution of $AgNO_3$) and a halide solution (e.g., an aqueous solution of NaCl) are added and their addition speeds, amounts or/and concentrations can be increased to promote grain growth at the time of producing the silver halide grains of this invention.

The details of suitable methods are given, e.g., in British Patent 1,335,925, U.S. Pat. No. 3,672,900, 3,650,757 and 4,242,445, JP-A-55-142329, JP-A-55-158124, JP-A-58-113927, JP-A-58-113928, JP-A-58-111934, JP-A-58-111936 and so on.

Chemical sensitization techniques applicable to this invention include sulfur sensitization, selenium sensitization, noble metal sensitization, reduction sensitization, and combinations of two or more of these sensitization method.

Sulfur sensitization can be effected with an unstable sulfur-containing compounds. Examples of suitable sulfur sensitizers which can be used include thiosulfates (e.g. hypo), thioureas (e.g., diphenylthiourea, triethylthiourea, allylthiourea), rhodanines, mercapto compounds and other known sulfur compounds.

Selenium sensitization can be effected with an unstable selenium-containing compound. Examples of suitable selenium sensitizers which can be used include colloidal metallic selenium, selenoureas (e.g., N,N-dimethylselenourea, N,N-diethylselenourea), selenoketones, selenoamides and other known selenium compounds.

Noble metal sensitization can be effected using salts of noble metals such as gold, platinum, palladium, iridium, etc. In particular, gold salts are preferred. Examples of suitable gold sensitizers include chloroauric acid, potassium chloroaurate, potassium aurithiocyanate, gold sulfide, gold selenide and other known gold salts.

Reduction sensitization can be effected using known reducing compounds, such as stannous chloride, aminoiminomethanesulfinic acid, hydrazine derivatives, borane, silane compounds, polyamine compounds and so on.

Of these chemical sensitization methods, sulfur sensitization, selenium sensitization, gold sensitization and a combination thereof are preferred in particular.

The details of chemical sensitization are described in *Research Disclosure*, Volume 176, Item 17643 (RD 17643), ibid., Volume 187, Item 18716 (RD 18716), and ibid., Volume 307, Item 307105 (RD 307105).

Thiocyanates are preferably added to the emulsion of this invention. In particular, the use of thiocyanates is effective when a methine dye is employed as a spectral sensitizing dye. The term thiocyanates as used herein is intended to include water-soluble alkali metal salts (e.g., $Na^+$, $K^+$) of thiocyanic acid, quaternary salts (e.g., $NH_4^+$) of thiocyanic acid, and thiocyanic acid itself (HSCN). Indeed, these thiocyanates assume the form of water-soluble salt at the time of addition to the high chloride-content silver halide emulsion of this invention, but a part or most of the thiocyanates added is presumed to be present in the emulsion in the form of silver thiocyanate.

The amount of the thiocyanate added is not limited, but ranges generally from $10^{-5}$ to $10^{-1}$ mole, preferably from $10^{-4}$ to $10^{-2}$ mole, per mole of silver halide.

The time at which the thiocyanate is added may be either before or after the addition of spectral sensitizing dyes. Also, it may be added either before or after the formation of high silver chloride-content grains of this invention.

The emulsion of this invention may be spectrally sensitized using methine dyes or other dyes. Suitable methine dyes include cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes, and complex merocyanine dyes. The nuclei usually present in cyanine dyes can be basic heterocyclic nuclei. More specifically, suitable basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-described nuclei and an alicyclic hydrocarbon ring; and nuclei formed by fusing together one of the above-described nuclei and an aromatic hydrocarbon ring. Specific examples of these fused nuclei include indolenine, benzindolenine, indole, benzoxazole, naphthoxazole, benzothiazole, naphthothiazole, benzoselenazole, benzimidazole, quinoline and like nuclei. Each of these nuclei may contain substitutents present on the carbon atoms thereof.

The merocyanine and complex merocyanine dyes can contain 5- or 6-membered heterocyclic nuclei, such as pyrazoline-5-one, thiohydantoin, 2-thioxazolidine-2,4-dione, thiazolidine-2,4-dione, rhodanine, thiobarbituric acid and like nuclei, as ketomethylene structure-containing nuclei.

More specifically, the compounds described in *Research Disclosure*, Item 17643, page 23 IV (Dec. 1978) and the compounds described in references cited therein can be used.

The addition of such dyes to the emulsion of this invention may be carried out at any stage during emulsionpreparation. Indeed spectral sensitizing dyes are generally added within the period from the conclusion of chemical sensitization to just before emulsion-coating, but they may be added simultaneously with chemical sensitizers to achieve spectral sensitization and chemical sensitization at the same time, as disclosed in U.S. Pat. Nos. 3,628,969 and 4,225,666, or, as disclosed in JP-A-58-113928, they may be added prior to chemical sensitization or before the completion of precipitation of silver halide grains to initiate spectral sensitization. Further, as described in U.S. Pat. No. 4,225,666, it is possible to add the spectral sensitizing dyes portionwise, that is to say, to add part of the spectral sensitizing dyes prior to chemical sensitization and the remaining part after chemical sensitization. Furthermore, as disclosed in U.S. Pat. No. 4,183,756 and so forth, the spectral sensitizing dyes, may be added at any time during the formation of the silver halide grains.

The amount of spectral sensitizing dyes added generally ranges from about $4\times10^{-6}$ to about $8\times10^{-3}$ mole, preferably from $10^{-5}$ to $5\times10^{-3}$ mole, per mole of silver halide.

Spectral sensitizing dyes which can be particularly advantageously used in this invention include those represented by the following general formulae (D-1) and (D-II):

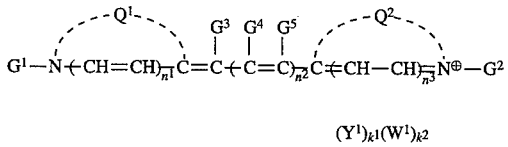

(D-1)

In the above formula (D-1), $Q^1$ and $Q^2$ may be the same or different, and each represents the atoms necessary to complete a cyclic nucleus derived from a basic heterocyclic compound usually employed as a cyanine dye. Specific examples include oxazoline, oxazole, benzoxazole, naphthoxazoles (e.g., naphtho[2,1-d]oxazole, naphtho[1,2-d]oxazole, naphtho-[2,3-d]oxazole), thiazoline, thiazole, benzothiazole, naphthothiazoles (e.g., naphtho[1,2-d]thiazole, naphtho[2,1-d]thiazole, naphtho[2,3-d]thiazole), dihydronaphthothiazoles (e.g., 8,9-dihydronaphtho[1,2-d]thiazole), selenazoline, selenazole, benzoselenazole, naphthoselenazoles (e.g., naphtho[1,2-d]selenazole, naphtho[2,1-d]selenazole), 3H-indoles (e.g., 3,3-dimethyl-3H-indole), benzindoles, imidazoline, imidazole, benzimidazole, naphthoimidazoles (e.g., naphtho[1,2-d]imidazole, naphtho[2,3-d]imidazole), pyridine, quinoline, imidazo[4,5-b]quinoxaline, pyrrolidine, and so on. The above-described nuclei may include various substituent groups on their respective rings. Examples of suitable substituent groups which may be present on these basic heterocyclic nuclei include a hydroxyl group, a halogen atom (e.g., fluorine, chlorine, bromine, iodine), an unsubstituted or substituted alkyl group (e.g., methyl, ethyl, propyl, isopropyl, butyl, cyclohexyl, octyl, decyl, octadecyl, 2-hydroxyethyl, 3-sulfopropyl, carboxymethyl, ethoxycarbonylmethyl, 2-cyanoethyl, trifluoromethyl, methoxymethyl, benzyl, phenetyl), unsubstituted or substituted aryl groups (e.g., phenyl, 1-naphthyl, 2-naphthyl, 4-sulfophenyl, 3-carboxyphenyl, 4-biphenyl, tolyl, anisyl, 4-chlorophenyl, 2-thienyl, 2-furyl, 2-pyridyl, 4-pyridyl), an unsubstituted or substituted alkoxy group (e.g., methoxy, ethoxy, isopropoxy, decyloxy, 2-methoxyethoxy), an unsubstituted or substituted aryloxy group (e.g., phenoxy, 1-naphthoxy, 4-methoxyphenoxy, 4-methylphenoxy, 3-chlorophenoxy), an alkylthio group (e.g., methylthio, ethylthio, butylthio, decylthio), an arylthio group (e.g., phenylthio, p-tolylthio, p-anisylthio, 2-naphthylthio), a methylenedioxy group, a cyano group, an unsubstituted or substituted alkenyl group (e.g., vinyl, 1-butenyl, styryl), an unsubstituted or substituted amino group (e.g., anilino, dimethylamino, diethylamino, morpholino, monomethylamino, bis(hydroxyethyl)amino, acetamido, benzoylamido, methylsulfonylamino), a nitro group, a carboxyl group, an alkoxycarbonyl group (e.g., methoxycarbonyl, ethoxycarbonyl), an acyl group (e.g., acetyl, benzoyl, propionyl, methylsulfinyl, methylsulfonyl), a sulfo group, and so on.

$G^1$ and $G^2$ may be the same or different, and each represents an alkyl, aryl or alkenyl group which may be substituted or unsubstituted. Specific examples of such groups include methyl, ethyl, propyl, isopropyl, butyl, octyl, decyl, octadecyl, methoxyethyl, 2-ethoxyethyl, 2-hydroxyethyl, carboxymethyl, 2-carboxyethyl, 3-carboxypropyl, 2-sulfoethyl, 3-sulfopropyl, 3-sulfobutyl, 4-sulfobutyl, 4-sulfophenyl, 2-sulfatoethyl, 3-thiosulfatopropyl, 2-phosphonoethyl, chlorophenyl, allyl, 1-butenyl, 2,2,2-trifluoroethyl, 2,2,3,3-tetrafluoropropyl, phenetyl, 4-sulfophenetyl, 2-chloropropyl, 2-hydroxy-3-sulfopropyl, ethoxycarbonylmethyl, and so on.

$G^3$ represents a hydrogen atom, or a fluorine atom. In addition, it represents an unsubstituted or substituted alkyl group (e.g., methyl, ethyl, methoxyethyl) or may form an alkylene linkage together with $G^1$ to complete a 5- or 6-membered ring when $n^2$ is not zero.

$G^4$ and $G^5$ may be the same or different, and each represents a hydrogen atom, an unsubstituted or substituted lower alkyl group (e.g., methyl, ethyl, propyl, methoxyethyl, benzyl, phenethyl), or an aryl group (e.g., phenyl, anisyl, tolyl).

$n^1$ and $n^3$ each are 0 or 1, and $n^2$ is 0, 1, 2 or 3.

$Y^1$ represents a cationic group, $W^1$ represents an anionic group, and $k^1$ and $k^2$ each represents 0 or 1 depending on the presence or the absence of ionic substituent groups.

Further, it is also possible for both $G^3$ and $G^5$, two $G^4$'s (when $n^2$ is 2 or 3), two $G^5$'s (when $n^2$ is 2 or 3), or both $G^2$ and $G^5$ to represent atoms necessary to complete an alkylene linkage.

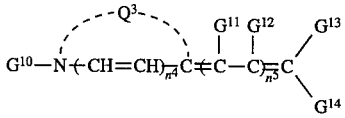

(D-II)

In the above formula (D-II), $Q^3$ has the same meaning as $Q^1$ or $Q^2$ in the foregoing general formula (D-I). $G^{10}$ has the same meaning as $G^1$ or $G^2$ in the foregoing general formula (D-I). $G^{11}$ and $G^{12}$ each represent a hydrogen atom, an unsubstituted or substituted lower alkyl group (e.g., methyl, ethyl, propyl, methoxyethyl, benzyl, phenethyl, 2-hydroxyethyl, 2-carboxyethyl), an aryl group (e.g., phenyl, naphthyl, 2-carboxyphenyl, tolyl, 4-chlorophenyl), or a halogen atom (e.g., fluorine, chlorine). Also, any two of $G^{10}$, $G^{11}$ and $G^{12}$ can represent the atoms necessary to complete an alkylene linkage.

$G^{13}$ and $G^{14}$ may be the same or different, and each represents an electron attracting group. Specific examples of such a group include a cyano group, an alkyl- or arylsulfonyl group (e.g., methylsulfonyl, phenylsulfonyl, tolylsulfonyl, octylsulfonyl), a carboxyl group, an alkyl- or arylcarbonyl group (e.g., acetyl, propionyl, decanoyl, benzoyl, tolylcarbonyl, 2-thienylcarbonyl), and a 5- or 6-membered nitrogen-containing heterocyclic group (e.g., 2-thiazolyl, 2-benzothiazolyl, 2-benzimidazolyl, 2-pyridyl, 2-benzoselenazolyl). In addition, $G^{13}$ and $G^{14}$ may combine with each other to complete a cyclic acidic nucleus which is usually present in merocyanine, oxonol and hemicyanine dyes. Specific examples of such a cyclic acidic nucleus include 2,4-oxazolidinediones (e.g., 3-ethyl-2,4-oxazolidinedione), 2,4-thiazolidinediones (e.g., 3-butyl-2,4-thiazolidinedione), 2-thio-2,4-oxazolidinediones (e.g., 3-phenyl-2-thio-2,4-oxazolidinedione), rhodanines (e.g., 3-ethylrhodanine, 3-carboxymethylrhodanine, 3-(2-sulfoethyl)rhodanine, 3-phenylrhodanine, 3-furfurylrhodanine, 3-(3-dimethylaminopropyl)rhodanine, 3-(2-ethoxyethyl-)rhodanine, 3-benzylrhodanine), hydantoins (e.g., 1,3-diethylhydantoin), 2-thiohydantoins (e.g., 1,3-diethyl-2-thiohydantoin, 1-ethyl-3-phenyl-2-thiohydantoin, 1-(2-hydroxyethyl)-3-phenyl-2-thiohydantoin, 1-[2-(2-hydroxyethoxy)ethyl]-3-(2-pyridyl)-2-thiohydantoin, 1-N-(2-hydroxyethyl)aminocarbonylmethyl-3-phenyl-2-thiohydantoin), 2-pyrazoline-5-ones (e.g., 3-methyl-1-phenyl-2-pyrazoline-5-one, 3-methyl-1-(4-carboxybutyl)-2-pyrazoline-5-one, 3-methyl-1-(4-sulfophenyl)-2-pyrazoline-5-one), 2-isooxazoline-5-ones (e.g., 3-phenyl-2-isooxazoline-5-one), 3,5-pyrazolidinediones (e.g., 1,2-diphenyl-3,5-pyrazolidinedione), 1,3-indanedione, 1,3-dioxane-4,6-dione, 1,3-cyclohexanedione, pyrazolo[5,1-b]quinazoline, pyrazolo[5,1-b]quinazolone, barbituric acids (e.g., 1,3-diethylbarbituric acid), 2-thiobarbituric acids (e.g., 1,3-diethylbarbituric acid, 1,3-bis(2-methoxyethyl)-2-thiobarbituric acid), and so on.

$n^4$ is 0 or 1, and $n^5$ is 0, 1, 2 or 3.

Specific non-limiting examples of the above-described dyes are illustrated below.

1

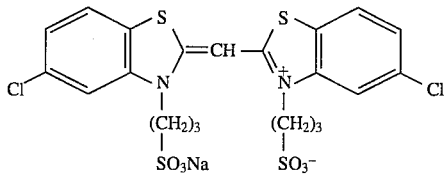

2

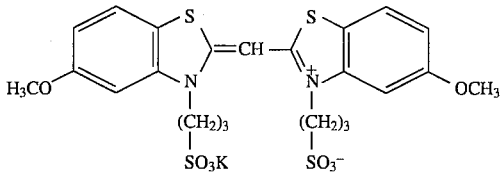

3

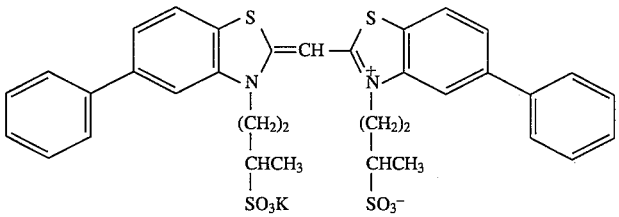

4

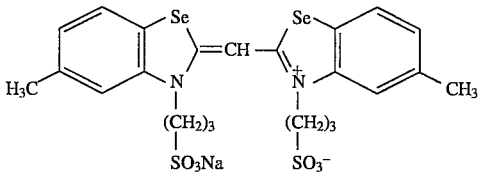

5

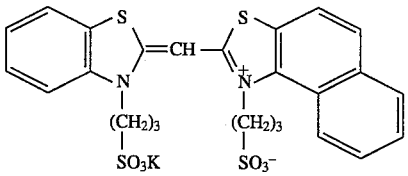

6

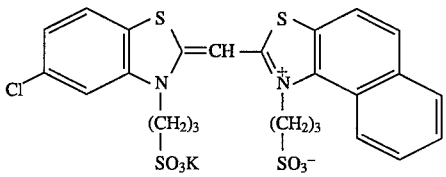

7

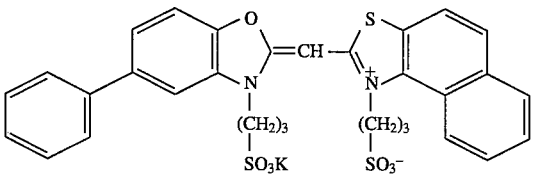

-continued
8
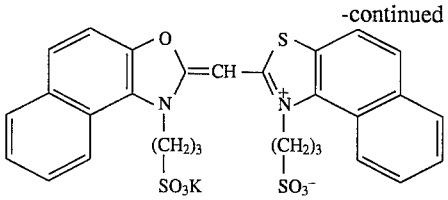
9
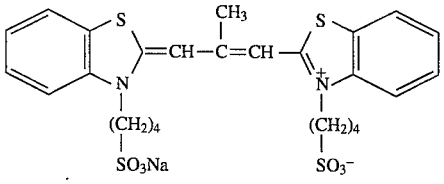
10
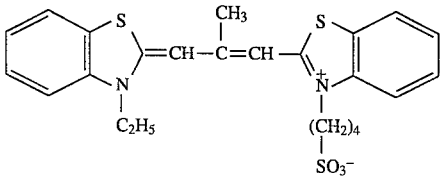
11
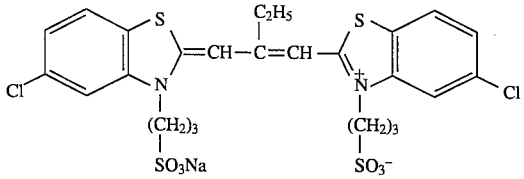
12
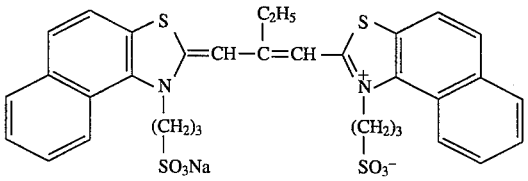
13
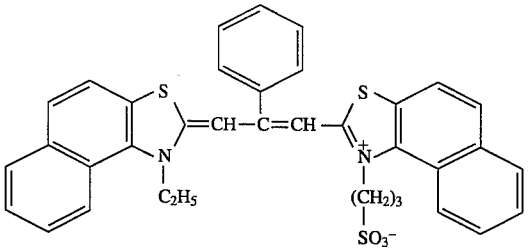
14
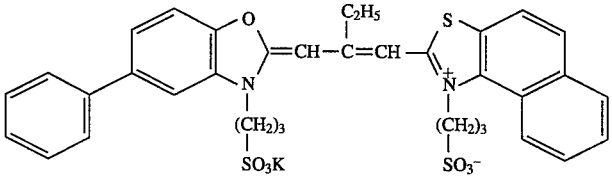
15
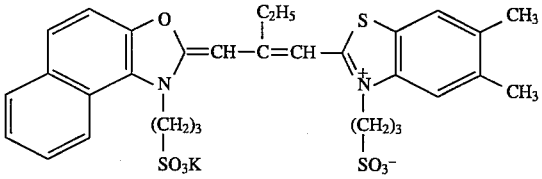

-continued
16
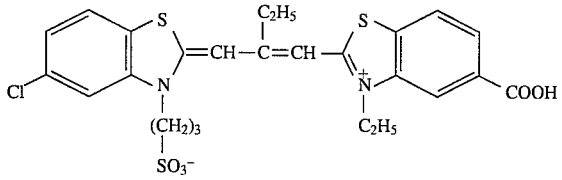
17
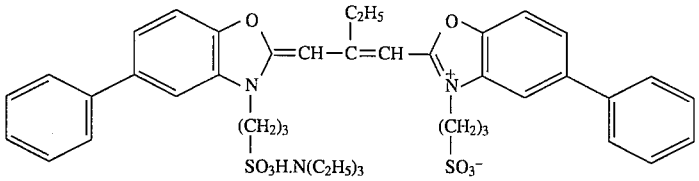
18
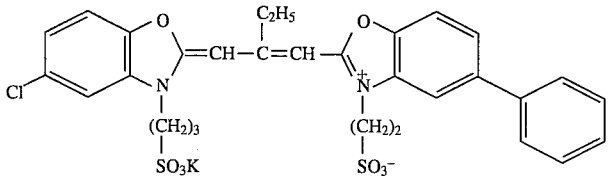
19
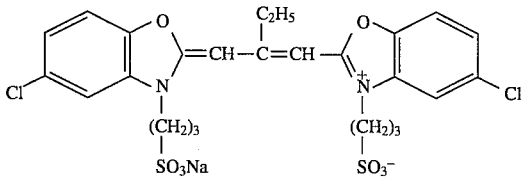
20
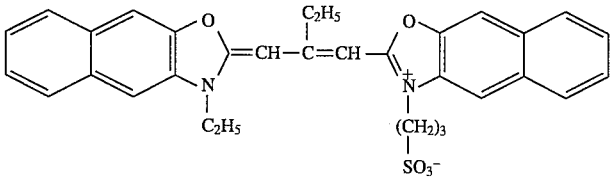
21
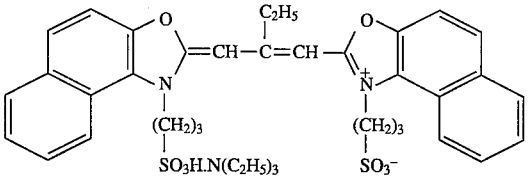
22
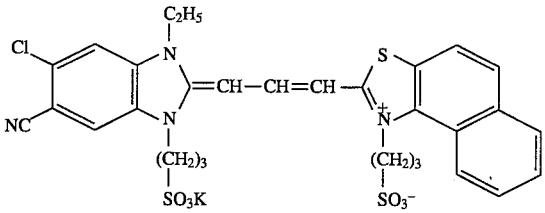
23
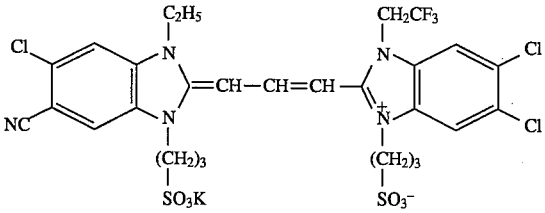

-continued
24
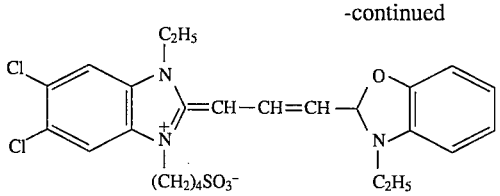
25
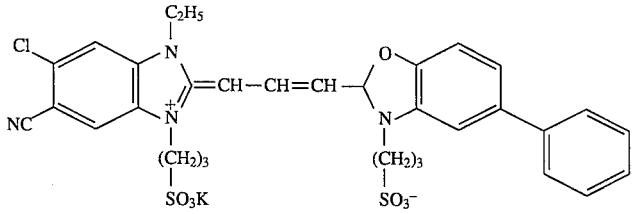
26
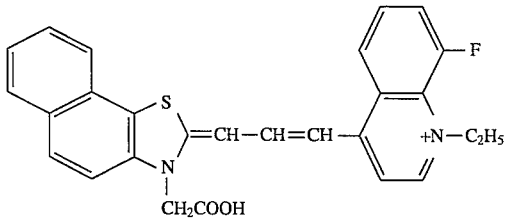
27
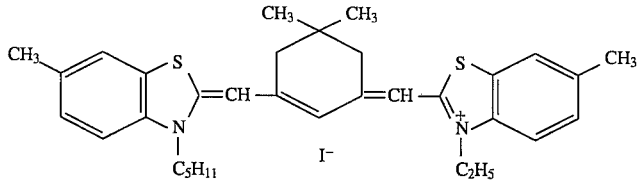
28
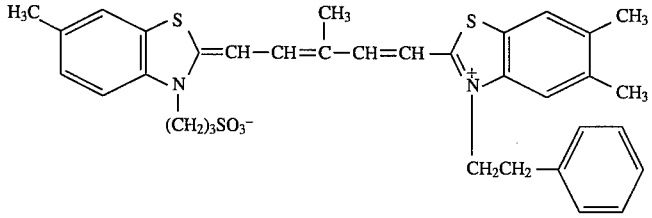
29
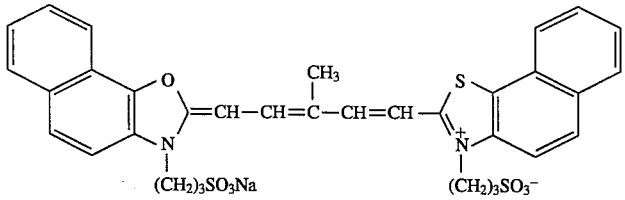
30
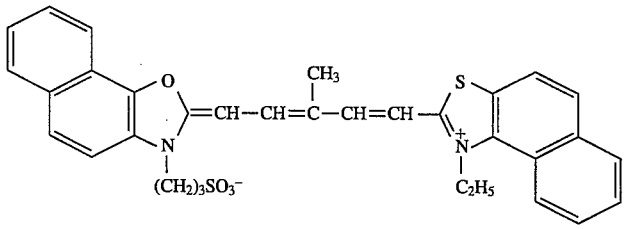
31
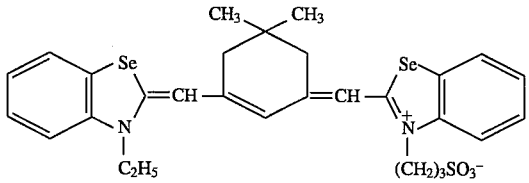

-continued
32
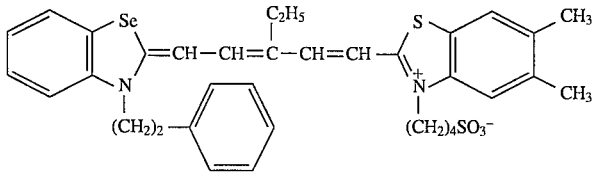
33
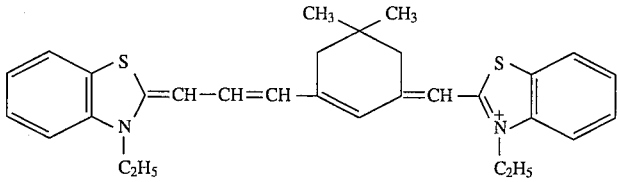
34
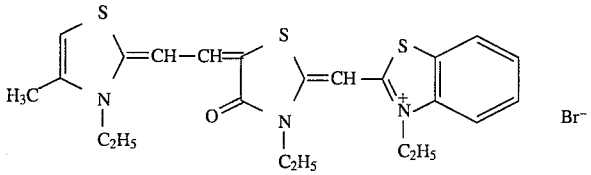
35
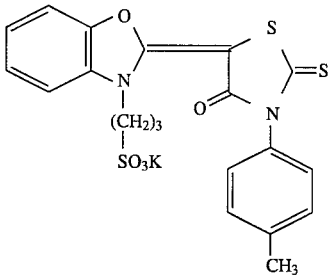
36
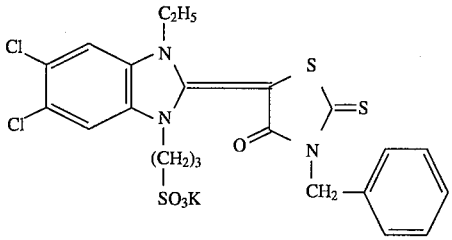
37
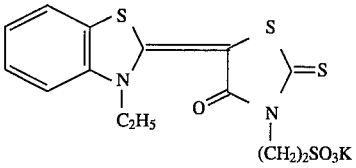
38
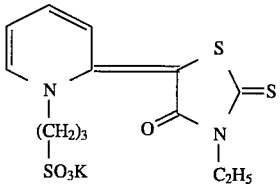
39
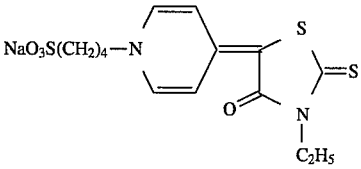

-continued

40

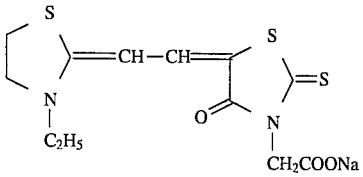

41

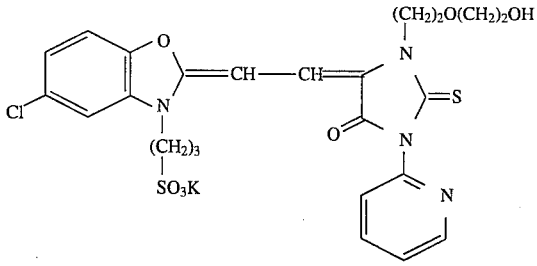

42

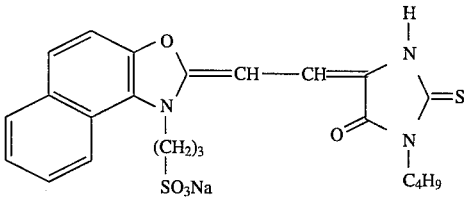

43

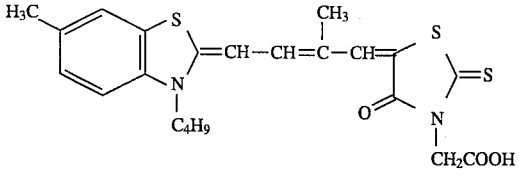

44

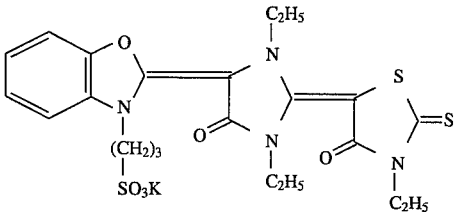

44

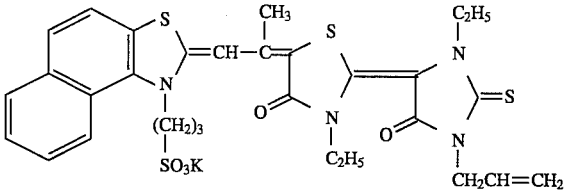

The silver halide emulsion prepared in accordance with this invention can be used in both color and black-and-white photographic materials.

Examples of suitable color photographic material to which the present emulsion is particularly appropriate, include color papers, color photographic films and color reversal films. Suitable specific examples include black-and-white photographic materials, X-ray films, color films for amateur use and graphic arts films.

The silver halide emulsion of this invention is not limited as to additives, and which can be present details of additives which can be used are described in, e.g., in *Research Disclosure*, vol. 176, Item 17643 (RD 17643), ibid., vol. 187, Item 18716 (RD 18716), and ibid., vol. 307, Item 307105 can be referred to.

The respective pages on which various additives are described in RD 17643 and RD 18716 are summarized in the following table.

| Additives | RD-17643 | RD-18716 |
|---|---|---|
| 1. Chemical Sensitizers | p. 23 | p. 648 (right column) |
| 2. Sensitivity-Increasing Agents | | p. 648 (right column) |
| 3. Spectral Sensitizers and Supersensitizers | pp. 23–24 | p. 648, right column, to p. 649, right column |
| 4. Brightening Agents | p. 24 | |
| 5. Antifoggants and Stabilizers | pp. 24–25 | p. 649, right column |
| 6. Light Absorbents, Filter dyes and IR-Ray Absorbents | pp. 25–26 | p. 649, right column, to P.650, left column |
| 7. Stain Inhibitors | p. 25, right | p. 650, left |

-continued

| Additives | RD-17643 | RD-18716 |
|---|---|---|
| | column | to right column |
| 8. Dye Image Stabilizers | p. 25 | |
| 9. Hardeners | p. 26 | p. 651, left column |
| 10. Binders | p. 26 | p. 651, left column |
| 11. Plasticizers and Lubricants | p. 27 | p. 650, right column |
| 12. Coating Aids and and Surfactants | pp. 26–27 | p. 650, right column |
| 13. Antistatic Agents | p. 27 | p. 650, right column |

Suitable antifoggants and stabilizers of the above-described additives include azoles (e.g., benzothiazolium salts, nitroimdazoles, nitrobenzimidazoles, chlorobenzimidazoles, bromobenzimidazoles, nitroindazoles, benzotriazoles, aminotriazoles), mercapto compounds (e.g., mercaptothiazoles, mercaptobenzothiazoles, mercaptobenzimidazoles, mercaptothiadiazoles, mercpatotetrazoles (especially 1-phenyl-5-mercaptotetrazole and its derivatives), mercaptopyrimidines, mercaptotriazines), thioketo compounds such as oxazolinethione, azaindenes (e.g., triazaindenes, tetraazaindenes (especially 4-hydroxy-6-methyl(1,3,3a,7)tetraazaindene), pentaazaindenes), benzenethiosulfonic acid, benzenesulfinic acid, benzenesulfonic acid amide, and so on.

Suitable color couplers desirably should be rendered nondiffusible by use of a hydrophobic group functioning as a ballast group, or by use of a polymerized coupler form. Additionally, they may be either four-equivalent or two-equivalent to silver ion. Further, colored couplers having a color correcting effect, or couplers capable of releasing a development inhibitor upon development (the so-called DIR couplers) may be employed. Furthermore, colorless DIR coupling compounds which produce a colorless compound on coupling and releasing a development inhibitor may be employed, as well.

Suitable examples of magenta couplers include 5-pyrazolone couplers, pyrazolobenzimidazole couplers, pyrazolotriazole couplers, pyrazolotetrazole couplers, cyanoacetylcumarone couplers and open-chain acylacetonitrile couplers. Examples of yellow couplers include acylacetamide couplers (e.g., benzoylacetanilides, pivaroylacetanilides), and examples of cyan couplers include naphthol couplers and phenol couplers. Phenol couplers having an ethyl group at the m-position of their respective phenol nuclei, 2,5-diacylamino substituted phenol couplers, phenol couplers having a phenylureido group at the 2-position and an acylamino group at the 5-position and naphthol couplers having a sulfonamido or amido group at the 5-position of their respective naphthol nuclei, as disclosed in U.S. Pat. Nos. 3,772,002, 3,772,162, 3,758,308, 4,126,396, 4,334,011, 4,327,173, 3,446,622, 4,333,999, 4,451,559, 4,427,767 and so on, are preferred as cyan couplers over other cyan couplers because of the excellent fastness of the images produced therefrom.

Two or more of the above-described couplers can be incorporated together in the same layer for the purpose of achieving the characteristics required of photographic materials. Of course, the same coupler may be incorporated in two or more different layers.

Hydroquinones, 6-hydroxychromans, 5-hydroxycoumarans, spirochromans, p-alkoxyphenols, hindered phenols represented by bisphenols, gallic acid derivatives, methylenedioxybenzenes, aminophenols, hindered amines, and ether or ester derivatives obtained by silylating or alkylating the phenolic OH group of the above-cited compounds are typical examples of discoloration inhibitors which can be used. Also, metal complexes represented by (bissalicylaldoximato)nickel complexes and (bis-N,N-dialkyldithiocarbamoto)nickel complexes can be used for the above-described purpose.

Any known processing method and any known processing solution can be employed in the photographic processing of photosensitive materials prepared in accordance with this invention. The processing temperature is generally in the range of about 18° C. to about 50° C. Of course, temperatures higher than about 50° C. or lower than about 18° C. may be employed, if desired. This photographic processing may be either a photographic processing for forming a silver image (black-and-white photographic processing) or a photographic processing for forming a dye image (color photographic processing), depending upon the end-use purpose of the photosensitive material.

The developing solution employed for black-and-white photographic processing can contain one or more known developing agent, such as the dihydroxybenzenes (e.g., hydroquinone), 3-pyrazolidones (e.g., 1-phenyl-3-pyrazolidone), aminophenols (e.g., N-methyl-p-aminophenol) and so on.

A color developing solution is, in general, an alkaline aqueous solution containing a color developing agent. Suitable examples of color developing agents which can be used include known aromatic primary amine developers, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline).

Also, those color developing agents described in L.F.A. Mason, *Photographic Processing Chemistry*, pages 226–229, Focal Press, London (1966), U.S. Pat. Nos. 2,193,015 and 2,592,364, JP-A-48-64933, and so on may be also employed.

The color developer can contain pH buffering agents such as sulfites, carbonates, borates and phosphates of alkali metals, and development inhibitors or antifoggants such as bromides, iodides and organic antifoggants in addition to these color developing agents. Further, the developer may contain water softeners, preservatives such as hydroxylamine, etc., organic solvents such as benzyl alcohol, diethylene glycol, etc., development accelerators such as polyethylene glycol, quaternary ammonium salts, amines, etc., dye-forming couplers, competing couplers, fogging agents such as sodium borohydride, etc., auxiliary developers such as 1-phenyl-3-pyrazolidone, etc., viscosity imparting agents, polycarboxylic acid type chelating agents disclosed in U.S. Pat. No. 4,083,723, antioxidants disclosed in West German Patent Application (OLS) No. 2,622,950, and so on, if desired.

The photographic materials are generally subjected to a bleach-processing after the color development color photographic processing. The bleach-processing may be carried out simultaneously with a fixation-processing (bleach-fix processing), or separately therefrom. Examples of bleaching agents which can be used include compounds of polyvalent metals, such as Fe(III), Co(III), Cr(IV), Cu(II), etc., peroxy acids, quinones, nitroso compounds, and so on. More specifically, ferricyanides, dichromates, Fe(III) or Co(III) complex salts of organic acids, e.g., aminopolycarboxylic acids such as ethylenediaminetetraacetic acid, nitrilotriacetic acid, 1,3-diamino-2-propanoltetraacetic acid, etc., citric acid, tartaric acid, malic acid and so on, persulfates, permanganates and nitrosophenol can be used. Potassium ferricyanide, sodium ethylenediamine-tetraacetatoferrate(III) and ammonium ethylenediamine-tetraacetatoferrate(III) are useful in particular. Additionally, (ethylenediaminetetraacetato)iron(III) complex salts are useful in both the bleaching bath and the bleach-fix bath. Bleach accelerators as disclosed in U.S. Pat. No. 3,042,520 and 3,241,966, JP-B-45-8506 (The term "JP-B" as used herein means an "examined Japanese patent publication") and JP-B-45-8836, thiol compounds as disclosed in JP-A-53-65732, and other various additives can be added to the bleaching bath or the bleach-fix bath. After the bleach or bleach-fix processing, the photographic materials may be subjected to washing and stabilization processing in succession, or only to stabilization processing.

This invention is illustrated in greater detail by reference to the following examples. However, the invention should not be construed as being limited to these examples. Unless otherwise indicated herein, all parts, percents, ratios and the like are by weight.

EXAMPLE 1

<Preparation of Grains and Detection of Fogged Nuclei using Gold Intensification>

A silver chloride emulsion has the greatest tendency to generate fog, compared with other silver halide emulsions.

Fogged nuclei are presumed to be attributable to silver specks produced at the time of grain formation and were detected using a gold intensification treatment. The results obtained are described below.

(Emulsions A and B: This Invention)

Figure 3:
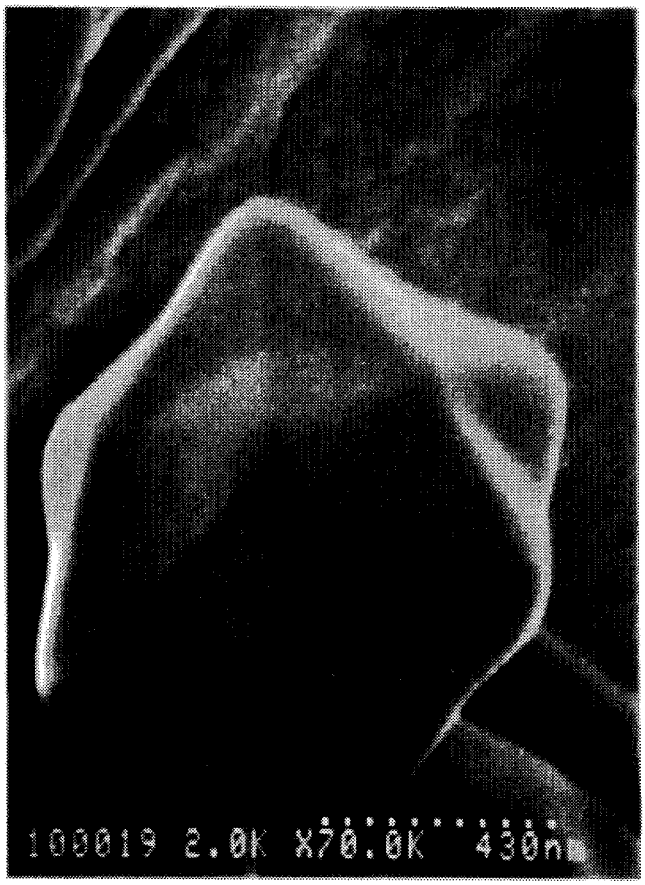
FIG. 3 and FIG. 4 are both electron micrographs (magnification: 70,000) of a grain of the silver halide crystal in Emulsion A obtained in Example 1 of this invention.
Figure 4:
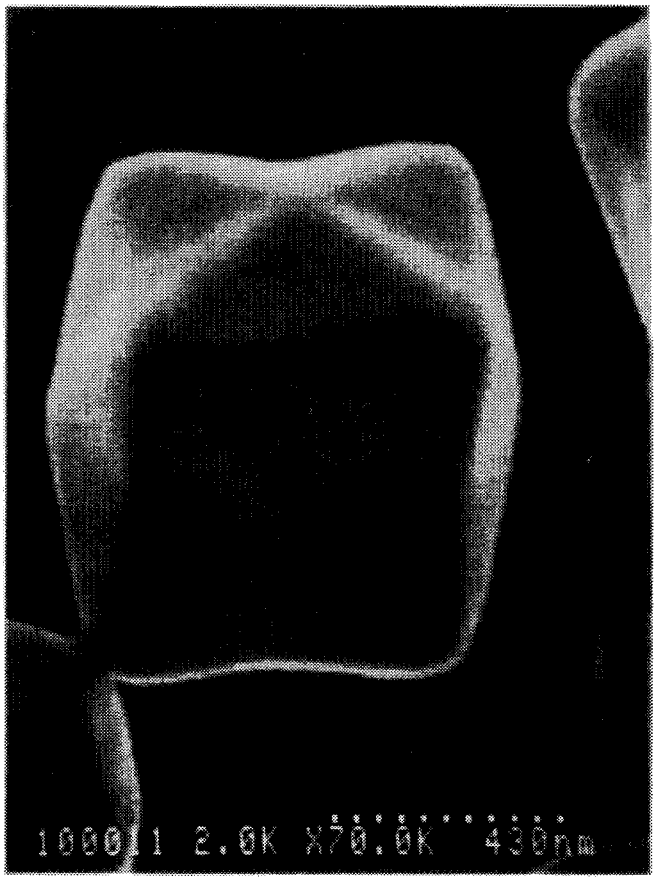
Figure 5:
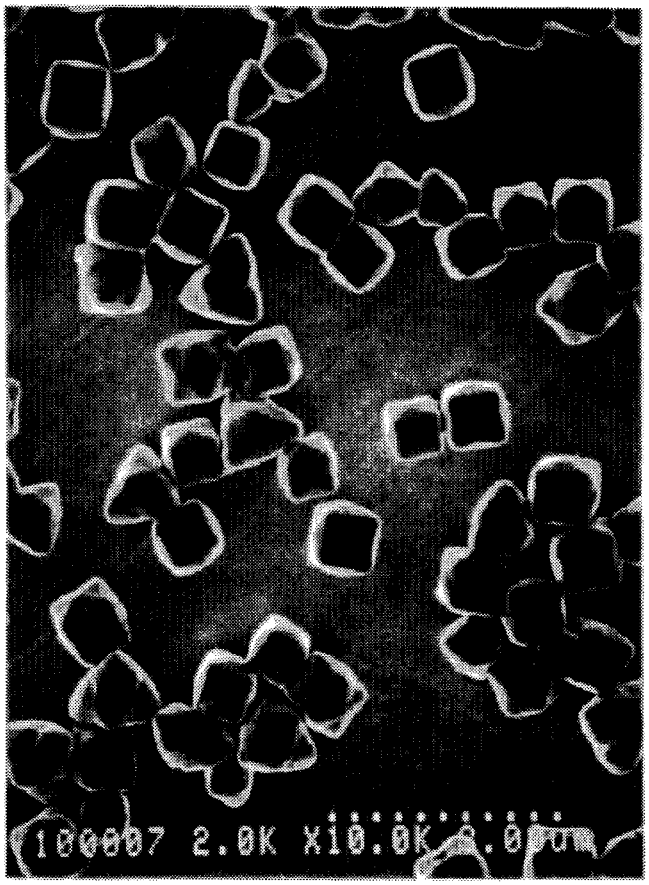
FIG. 5 is an electron micrograph (magnification: 10,000) of a number of grains of silver halide crystals in Emulsion A obtained in Example 1 of this invention.

To 800 ml of an aqueous solution containing 2.3 g of sodium chloride, kept at 60° C. and adjusted to pH 4.5, in which 5 g of P-3 (Emulsion A) or 6.8 g, which was determined so as to render the thioether content equal to the former, of P-5 (Emulsion B) was present as the synthetic peptizer of this invention, an aqueous silver nitrate solution (prepared by adding water to 120 g of $AgNO_3$ to make the volume 480 ml) and an aqueous sodium chloride solution (prepared by adding water to 42 g of NaCl to make the volume 480 ml) were added simultaneously. The time required for the addition was controlled to attain a grain size (edge length) of about 0.92 μm. Grains present in both the thus obtained Emulsion A and Emulsion B had an octatetracontahedral crystal form with both convex and concave parts as defined by this invention. Electron micrographs of Emulsion A are shown in FIGS. 3 and 4 (magnification: 70,000) and in FIG. 5 (magnification: 10,000).

After grain formation, 20 g of gelatin was added to each emulsion. The resulting emulsions each were washed using a flocculation method to remove soluble salts therefrom. Thereto, 76 g of gelatin was further added, followed by redispersion into 800 ml of water and adjustment to pH 6.2 and pAg 7.0 at 40° C.

(Emulsion C: Comparison)

Emulsion C having a grain size of about 0.92 μm [comparative emulsion] was prepared, washed and redispersed in the same manner as Emulsion A, except that 3-thiapentylacrylate/sodium 2-acrylamido-2-methylpropane-sulfonate copolymer (molar ratio: 1/6), designated P-A hereinafter, which was analogous to P-3 and P-5 but which had a low mole fraction of the monomer containing a thioether linkage (corresponding to 14.3 mol %), was used as the synthetic peptizer in an amount of 12.4 g so as to make the thioether content equal to that in Emulsion A.

The grains in the thus obtained emulsion had a cubic crystal form.

(Emulsions D and E: Comparison)

Emulsion D having a grain size of about 0.92 μm (comparative emulsion) was prepared in the same manner as Emulsion A, except that 20 g of gelatin was used in the place of the synthetic peptizer, and then subjected to washing using the conventional flocculation method and to redispersion. The thus obtained emulsion comprised cubic grains.

The resulting emulsion was divided into two portions. To one portion was added the synthetic peptizer P-3 in an amount of 5 g per 120 g of $AgNO_3$. The resulting emulsion was designated Emulsion E.

Each of the thus prepared emulsions, to which sodium dodecylbenzenesulfonate (as a coating aid) and a hardener of the formula, $CH_2{=}CH{-}SO_2{-}CH_2{-}CONH{-}CH_2{-}CH_2{-}NHCO{-}CH_2{-}SO_2{-}CH{=}CH_2$, were added prior to coating, was coated on a triacetyl cellulose film support together with a gelatin protective layer using the simultaneous extrusion method.

Each of the thus obtained samples was exposed to light (for 1/10 second) through an optical wedge, and cut into two pieces. One piece was immersed in a gold intensifier having the following composition for 30 seconds at 20° C., while the other piece was not treated with the gold intensifier. Then, the resulting pieces were washed with water for 10 minutes, developed with a developer of the following composition for 5 minutes at 20° C., and subjected to conventional stop, fixation, washing and drying steps. The photographic density of the thus processed pieces was examined using white light, and the quotient of the fog value (Fog) divided by the density of the entire developed grains (Dmax) in every sample piece was determined. The results obtained are set forth in Table 1.

| Gold Intensifier Composition: | |
|---|---|
| Chloroauric Acid | 40 mg |
| Potassium Thiocyanate | 0.5 g |
| Sodium Chloride | 0.3 g |
| Water to make | 1 l |
| **Developer Composition:** | |
| Metol | 2.5 g |
| Ascorbic Acid | 10 g |
| Sodium Metaborate Hydrate (Nabox) | 35 g |
| Sodium Chloride | 0.5 g |
| Water to make | 1 l |

TABLE 1

| | | Fog/Dmax | | |
|---|---|---|---|---|
| Sample | Emulsion | Without Gold Intensification | With Gold Intensification | Note |
| 1 | A | 0.03 | 0.06 | Invention |
| 2 | B | 0.03 | 0.08 | Invention |
| 3 | C | 0.03 | 0.46 | Comparison |
| 4 | D | 0.03 | 0.59 | Comparison |
| 5 | E | 0.03 | 0.59 | Comparison |

As apparent from the results in Table 1 above, both of the emulsions of this invention, A and B, were fogged very little, even though they had been subjected gold intensification; accordingly fog nuclei were found to be hardly introduced into AgCl grains at the time of grain formation.

In contrast, marked fog generation due to gold intensification was detected in Emulsion C for comparison which had been prepared using a synthetic peptizer which had a low thioether content and in comparison Emulsion D which had been prepared using gelatin as a peptizer; accordingly fog nuclei were shown to be markedly introduced into the AgCl grains at the time of grain formation.

In addition, the synthetic peptizers themselves used in this invention have been proven to have no fog-inhibiting effect from a comparison of the Emulsion D and the Emulsion E results.

Thus, it is evident from the analytical experiments described above that the emulsions of this invention have markedly reduced tendency to fog.

EXAMPLE 2

Ten types of emulsions including Emulsions A, B, C, D and E prepared as described in Example 1 were prepared as follows: Emulsions F, G, H and I were prepared in the same manner as Emulsion A, except that P-7, P-10, P-13 and P-17 were used respectively as a synthetic peptizer in the place of P-3 in 10 g portions; while Emulsion A' was prepared in the same manner as Emulsion A, except that after the desalination subsequent to spontaneous precipitation of the grains formed in the presence of P-3 the emulsion was re-dispersed into 800 ml of water without adding any gelatin thereto. Additionally, Emulsion A' was adjusted to the same pH and pAg as in Emulsion A. To each of these ten kinds of emulsions, triethylthiourea and chloroauric acid were added and heated at 55° C. to effect optimal sulfur-gold sensitization. Then, gelatin was added to Emulsion A' alone. Thereafter, each of the resulting emulsions was admixed with Yellow Coupler (a) and Dye Image Stabilizer (b), and further successively with, 4-hydroxy-6-methyl-1,3,3a,7-tetrazaindene (stabilizer), 1-[3-(3-methylureido)phenyl]-5-mercaptotetrazole (antifoggant), N-allylbenzothiazolium p-toluenesulfonate (latent image stabilizer), sodium 2,4-dichloro-6-hydroxy-s-triazine (hardener) and sodium dodecylbenzenesulfonate (coating aid).

(a) Yellow Coupler

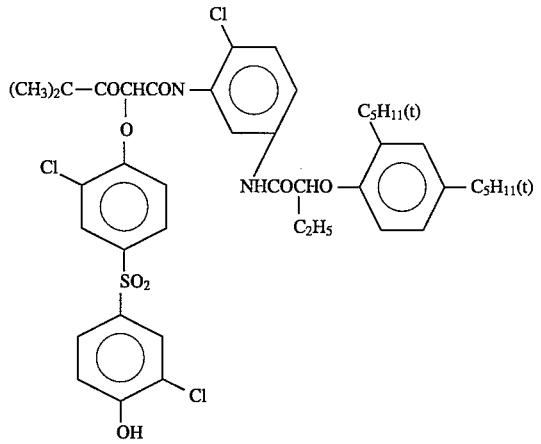

(b) Dye Image Stabilizer

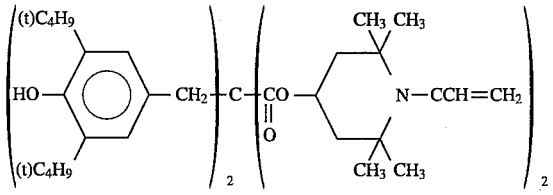

Each of the thus prepared emulsions was coated on a paper support laminated with polyethylene on both sides together with a gelatin protective layer to obtain photosensitive samples.

The samples each were exposed to light (1/10 second) through an optical wedge, and subjected to a photographic processing comprising the following steps to obtain the results shown in Table 2 below.

The sensitivities, defined by the reciprocal of the exposure required to attain a density of fog +0.5, are shown as relative values, with Sample 11 being taken as 100.

| Color Developer (33° C., 60 seconds' development): | |
|---|---|
| Water | 800 ml |
| Diethylenetriaminepentaacetic Acid | 1.0 g |
| Sodium Sulfite | 0.2 g |
| N,N-diethylhydroxylamine | 4.2 g |
| Potassium Bromide | 0.01 g |
| Sodium Chloride | 1.5 g |
| Triethanolamine | 8.0 g |
| Potassium Carbonate | 30 g |
| N-Ethyl-N-(β-methanesulfonamidoethyl)-3-methyl-4-amino-aniline Sulfate | 4.5 g |
| 4,4'-Diaminostilbene type Brightening Agent (Whitex 4, produced by Sumitomo Chemical Co., Ltd.) | 2.0 g |
| Water to make | 1,000 ml |
| KOH to adjust | pH 10.25 |
| **Bleach-Fix Bath (35° C., 45 seconds):** | |
| Ammonium Thiosulfate (54 wt % aq. soln.) | 150 ml |
| $Na_2SO_3$ | 15 g |
| $NH_4$[Fe(III) (EDTA)] | 55 g |
| EDTA.2Na | 4 g |
| Glacial Acetic Acid | 8.61 g |
| Water to make | 1,000 ml (pH 5.4) |
| **Rinsing Solution (35° C., 90 seconds):** | |
| EDTA.2Na.$2H_2O$ | 0.4 g |
| Water to make | 1,000 ml (pH 7.0) |

TABLE 2

| Sample | Emulsion | Peptizer during Grain Formation | Fog | Relative Sensitivity | Note |
|---|---|---|---|---|---|
| 11 | D | gelatin | 0.30 | 100 | Comparison |
| 12 | E | gelatin | 0.30 | 100 | Comparison |
| 13 | C | P-A | 0.16 | 205 | Comparison |
| 14 | A | P-3 | 0.05 | 398 | Invention |
| 15 | A' | P-3 | 0.04 | 408 | Invention |
| 16 | B | P-5 | 0.06 | 335 | Invention |
| 17 | F | P-7 | 0.08 | 340 | Invention |
| 18 | G | P-10 | 0.08 | 316 | Invention |
| 19 | H | P-13 | 0.07 | 324 | Invention |
| 20 | I | P-17 | 0.08 | 309 | Invention |

As can be seen from the data in Table 2, the emulsions of this invention provided an excellent results in that only slight fog occurred and remarkably high sensitivity was achieved. In addition, the result with Emulsion A' demonstrates that the absence of gelatin at the time of chemical sensitization as well as at the time of grain formation produces a slightly better effect upon the emulsion of this invention, although certain precautions were needed in handling, such as washing, because it was in liquid state.

Additionally, when sulfur sensitization using triethylthiourea alone was carried out in the place of the sulfur-gold sensitization, the emulsions of this invention, A, A', B, F, G, H and I, produced similar results in that they only slight fog was generated and high sensitivity was achieved, as compared with the emulsions D, E and F.

EXAMPLE 3

Silver chlorobromide Emulsions 1 to 10 were prepared by simultaneously adding an aqueous silver nitrate solution (containing 120 g of $AgNO_3$) and an aqueous solution of potassium bromide-sodium chloride mixture (with an appropriately changed KBr/NaCl ratio) to 1,000 ml portions of aqueous solutions containing 2.9 g of sodium chloride and the respective peptizers as set forth in Table 3 below.

The temperature during grain formation and the addition rates of the silver salt/the halides were controlled so as to adjust every edge length to 0.9 μm.

The halide compositions of the prepared emulsions were determined by X-ray diffraction spectra, and the chloride contents are set forth in Table 3 below.

25 g of gelatin was added to each of Emulsions 2, 4, 6, 8 and 10, after the grain formation.

Thereafter, each emulsion was desalted and washed using the conventional flocculation method, and then admixed with 90 g of gelatin and water, and further adjusted to pH 6.2 and to pAg 7.0 (Emulsions 7–10) or 7.5 (Emulsions 1–6) at 40° C. (total volume of each emulsion: 800 ml).

Each emulsion was heated to 56° C., and subjected to optimal gold-sulfur sensitization using sodium thiosulfate and chloroauric acid. The same additives as used in Example 2 were added thereto, and samples were prepared therefrom. The samples obtained were exposed to light and subjected to the same photographic processing as described in Example 2.

The relative sensitivities in Table 3 below are set out for comparison between each pair of samples having the same halide composition, with each sample in which gelatin was used as a peptizer being taken as 100.

TABLE 3

| Sample | Emulsion | Cl Content | Peptizer (Amount: g) | Relative Sensitivity | Note |
|---|---|---|---|---|---|
| 21 | 1 | 55 mol % | Gelatin (25) | 100 | Comparison |
| 22 | 2 | 55 mol % | P-3 (5) | 100 | Comparison |
| 23 | 3 | 65 mol % | Gelatin (25) | 100 | Comparison |
| 24 | 4 | 65 mol % | P-3 (5) | 132 | Invention |
| 25 | 5 | 85 mol % | Gelatin (25) | 100 | Comparison |
| 26 | 6 | 85 mol % | P-3 (5) | 185 | Invention |
| 27 | 7 | 95 mol % | Gelatin (25) | 100 | Comparison |
| 28 | 8 | 95 mol % | P-3 (5) | 315 | Invention |
| 29 | 9 | 99 mol % | Gelatin (25) | 100 | Comparison |
| 30 | 10 | 99 mol % | P-3 (5) | 380 | Invention |

As can be seen from the data in Table 3, the difference in sensitivity between the grains of this invention and the conventional grains formed in the presence of gelatin was small with respect to the emulsions with low silver chloride content, but the difference was radically increased with an increase in silver chloride content of the emulsion.

EXAMPLE 4

Emulsions A, A', B, F, C and D which had been prepared, washed and redispersed in the same manner as in described Example 2 were each heated to 55° C., and subjected to sulfur-gold sensitization using triethylthiourea and chloroauric acid to an optimal extent. After cooling to 40° C., gelatin was added to Emulsion A' alone, and each of the resulting emulsions was divided into 2 or 5 portions. Thereafter, each was admixed successively with, potassium thiocyanate and Green-Sensitive Sensitizing Dye (17) ($3.0\times10^{-4}$ mol/mol Ag). Further, the resulting emulsions each were admixed with Magenta Coupler (M) and Dye Image Stabilizer (b), and further successively with, 4-hydroxy-6-methyl-1,3,3a,7-tetrazaindene (stabilizer), 1-[3-(3-methylureido)phenyl]-5-mercaptotetrazole (antifoggant), N-allylbenzothiazolium p-toluenesulfonate (latent image stabilizer), sodium 2,4-dichloro-6-hydroxy-s-triazine (hardener) and sodium dodecylbenzenesulfonate (coating aid).

Magenta Coupler (M)

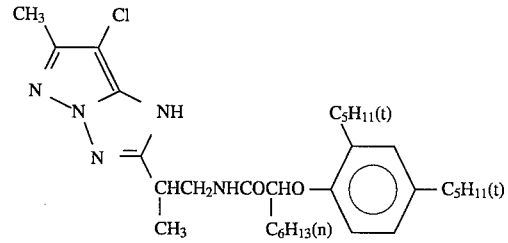

Dye Image Stabilizer (b)

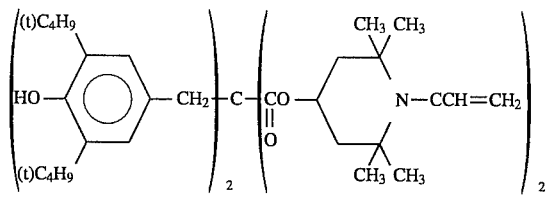

The thus prepared emulsions each were coated on a paper support laminated with polyethylene on both sides together with a gelatin protective layer to obtain photosensitive samples.

The samples each were exposed to light (1/10 second) through an optical wedge. Upon exposure, two kinds of filters, namely SC-50 filter, made by Fuji Photo Film Co., Ltd., for determination of color sensitivity, and a 365 nm interference filter for determination of intrinsic sensitivity, were used at the same time. The sensitivities obtained are shown in Table 4 below.

The color sensitivities and the intrinsic sensitivities, although defined by the reciprocal of the exposure required for attaining a density of fog +0.5, are shown as relative values, with Sample 31 being taken as 100.

The samples which had been exposed to light were subjected to a continuous processing (running test) wherein a paper processor was used, and the processing consisted of the following steps using processing solutions having the compositions described below and was continued until the amount of the replenisher used became twice the volume of the developing tank used.

| Processing Step | Temperature | Time | Amount* Replenished | Tank Volume |
|---|---|---|---|---|
| Color Development | 35° C. | 45 sec. | 161 ml | 17 1 |
| Bleach-Fix | 30–35° C. | 45 sec. | 215 ml | 17 1 |
| Rinsing (1) | 30–35° C. | 20 sec. | — | 10 1 |
| Rinsing (2) | 30–35° C. | 20 sec. | — | 10 1 |
| Rinsing (3) | 30–35° C. | 20 sec. | 350 ml | 10 1 |
| Drying | 70–80° C. | 60 sec. | | |

-continued

| Processing Step | Temperature | Time | Amount* Replenished | Tank Volume |
|---|---|---|---|---|

*per $m^2$ of light-sensitive material
(The rinsing was carried out according to 3-stage counter current process in the direction of from Tank 3 to Tank 1)

The composition of each processing solution used was as follows.

| | Tank Solution | Replenisher |
|---|---|---|
| Color Developer: | | |
| Water | 800 ml | 800 ml |
| Ethylenediamine-N,N,N,N-tetramethylenephosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-Ethyl-N-(A-methanesulfonamidoethyl)-3-methyl-4-aminoaniline-sulfate | 5.0 g | 7.0 g |
| N,N-bis(Carboxymethyl)hydrazine | 4.0 g | 5.0 g |
| N,N-Di(sulfoethyl)hydroxylamine.1Na | 4.0 g | 5.0 g |
| Brightening Agent (Whitex 4B, produced by Sumitomo Chemical Co., Ltd.) | 1.0 g | 2.0 g |
| Water to make | 1,000 ml | 1,000 ml |
| pH (25° C.) adjusted to | 10.05 | 10.45 |
| Bleach-Fix Bath (Tank solution = Replenisher): | | |
| Water | 400 ml | |
| Ammonium Thiosulfate (70% aq. soln.) | 100 ml | |
| Sodium Sulfite | 17 g | |
| Ammonium Ethylenediaminetetraacetatoferrate(III) | 55 g | |
| Disodium Ethylenediaminetetraacetate | 5 g | |
| Ammonium Bromide | 40 g | |
| Water to make | 1,000 mlph (25° C.) adjusted | |
| to | 6.0 | |

Rinsing Bath (Tank solution=Replenisher):

Ion exchange water (in which calcium and magnesium ion concentrations were each below 3 ppm).

As can be seen from the data in Table 4, the generation of fog was less and the intrinsic sensitivity was markedly higher in the Emulsions, A, A', B and F of this invention than in the comparative Emulsions C and D. However, the spectral sensitivity attained by the addition of the sensitizing dye alone was much lower in the present emulsions than in the comparative emulsions.

On the other hand, the combined use of the sensitizing dye and potassium thiocyanate produced a marked effect on the enhancement of the spectral sensitivities of the emulsions of the present invention, while had no beneficial effect on the comparative emulsions but the combined use on the contrary caused a decrease in spectral sensitivity to occur.

Based on the measurements of absorption spectra of Samples 5 to 9 with a spectrophotometer, the percent absorptions of the dye at 550 nm were increased as the thiocyanate content increased, namely 41% in Sample 5, 55% in Sample 6, 72% in Sample 7, 80% in Sample 8 and 81% in Sample 9. This fact suggests that the adsorption of dye to the grains was significantly promoted by the combined use of the dye with thiocyanate.

EXAMPLE 5

Emulsions A and D which had been prepared and subjected to gold-sulfur sensitization in the same manner as described in Example 4 were each divided into 8 portions. To each portion was added a sensitizing dye alone or a combination of potassium thiocyanate and a sensitizing dye. As shown in Table 5 below, the sensitizing dyes used were Blue-Sensitive Sensitizing Dyes (6) and (35), and Red-Sensitive Sensitizing Dyes (11) and (27). The amount of dye used was $3.0\times10^{-4}$ mol/mol Ag. The emulsion-coated samples were prepared in the same manner as described in Example 4, except that Yellow Coupler (Y) was added in the place of Magenta Coupler (M) when a blue-sensitive sensitizing dye was used, while Cyan Coupler (C) was added when a red-sensitive sensitizing dye was used.

The prepared samples were exposed to light and development-processed in the same manner as described in Example 4, except that instead of using an SC-50 filter upon exposure an SC-46 filter, made by Fuji Photo Film Co., Ltd., was used when the blue-sensitive sensitizing dye was

TABLE 4

| Sample | Emulsion | Peptizer (amount used) | Amount of Potassium Thiocyanate (mol/mol Ag) | Fog | Relative Sensitivity under SC-50 Filter (Spectral Sensitivity) | Relative Sensitivity under 865 nm Filter (Intrinsic Sensitivity) | Note |
|---|---|---|---|---|---|---|---|
| 31 | D | gelatin 20 g | — | 0.28 | 100 | 100 | Comparison |
| 32 | D | gelatin | $2\times10^{-3}$ | 0.28 | 93 | 104 | Comparison |
| 33 | C | P-A* 12.4 g | — | 0.15 | 210 | 200 | Comparison |
| 34 | C | P-A* | $2\times10^{-3}$ | 0.15 | 196 | 210 | Comparison |
| 35 | A | P-3 5 g | — | 0.05 | 82 | 390 | Invention |
| 36 | A | P-3 5 g | $5\times10^{-5}$ | 0.05 | 185 | 390 | Invention |
| 37 | A | P-3 5 g | $2\times10^{-4}$ | 0.05 | 370 | 400 | Invention |
| 38 | A | P-3 5 g | $8\times10^{-4}$ | 0.05 | 410 | 405 | Invention |
| 39 | A | P-3 5 g | $2\times10^{-3}$ | 0.05 | 405 | 400 | Invention |
| 40 | A' | P-3 5 g | — | 0.04 | 84 | 404 | Invention |
| 41 | A' | P-3 5 g | $8\times10^{-4}$ | 0.04 | 420 | 418 | Invention |
| 42 | B | P-5 6.8 g | — | 0.06 | 72 | 350 | Invention |
| 43 | B | P-5 6.8 g | $8\times10^{-4}$ | 0.06 | 350 | 365 | Invention |
| 44 | F | P-7 10 g | — | 0.08 | 70 | 330 | Invention |
| 45 | F | P-7 10 g | $8\times10^{-4}$ | 0.08 | 330 | 342 | Invention |

*P-A: 3-Thiapentylacrylate/sodium 2-acrylamido-2-methyl-propanesulfonate copolymer (⅙ by mole), which provided cubic grains similar to the grains achieved with gelatin because of its low mole fraction of thioether linkage-containing monomer (14.3 mol %).

present and an SC-52 filter, made by Fuji Photo Film Co., Ltd., was used when the red-sensitive sensitizing dyes was present. The results obtained are shown in Table 5 below.

The sensitivities are shown as relative values for each group in which the same sensitizing dye was used, with the sample containing Emulsion D being taken as 100.

(Y) Yellow Coupler:

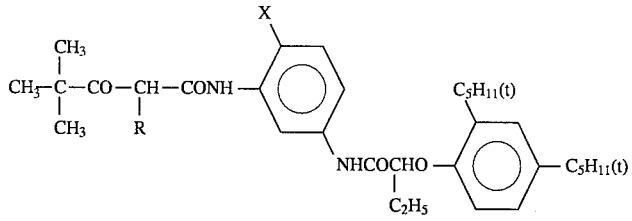

1:1 (by mole) mixture of that containing

R = 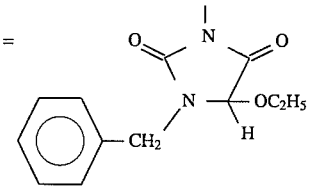 and X = Cl and that containing R = 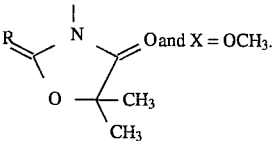 and X = $OCH_3$.

(C) Cyan Coupler:

1:1 (by mole) mixture of 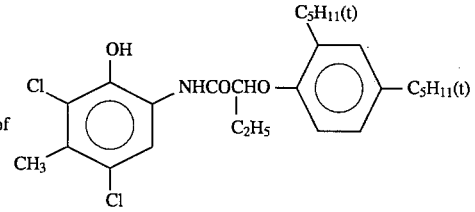

and 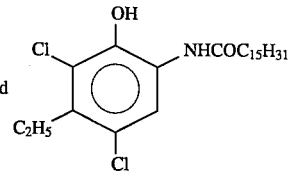

TABLE 5

| Sample | Emulsion | Sensitizing Dye | Potassium Thiocyanate (amount added: mol/mol Ag) | Relative Spectral Sensitivity | Note |
|---|---|---|---|---|---|
| 46 | D | (6) | — | 100 | Comparison |
| 47 | D | (6) | $8 \times 10^{-4}$ | 100 | Comparison |
| 48 | A | (6) | — | 65 | Invention |
| 49 | A | (6) | $8 \times 10^{-4}$ | 390 | Invention |
| 50 | D | (35) | — | 100 | Comparison |
| 51 | D | (35) | $8 \times 10^{-4}$ | 105 | Comparison |
| 52 | A | (35) | — | 180 | Invention |
| 53 | A | (35) | $8 \times 10^{-4}$ | 405 | Invention |
| 54 | D | (11) | — | 100 | Comparison |
| 55 | D | (11) | $8 \times 10^{-4}$ | 95 | Comparison |
| 56 | A | (11) | — | 50 | Invention |

TABLE 5-continued

| Sample | Emulsion | Sensitizing Dye | Potassium Thiocyanate (amount added: mol/mol Ag) | Relative Spectral Sensitivity | Note |
|---|---|---|---|---|---|
| 57 | A | (11) | $8 \times 10^{-4}$ | 370 | Invention |
| 58 | D | (27) | — | 100 | Comparison |
| 59 | D | (27) | $8 \times 10^{-4}$ | 90 | Comparison |
| 60 | A | (27) | — | 40 | Invention |
| 61 | A | (27) | $8 \times 10^{-4}$ | 310 | Invention |

As can be seen from the results in Table 5, although the color sensitivities attained in Emulsion A of the present invention by the independent addition of the dyes were inferior to those attained in comparative Emulsion D, the color sensitivities of the present emulsion were markedly increased by the combined addition of the dye and thiocyanate. This marked effect was achieved with each dye.

This marked increase in color sensitivity of the present emulsion due to the combined use of a sensitizing dye and thiocyanate was also obtained in silver chlorobromide emulsions prepared in accordance with this invention as long as the chloride content was 60 mol % or more.

In accordance with the embodiments of this invention, a silver halide photographic emulsion of the kind which hardly generates fog despite its high chloride content and, additionally which hardly suffers from an increase in fog due to chemical sensitization, and has an improved color sensitization and a high sensitivity and aptitude for rapid processing can be obtained. In addition, high spectral sensitivities can be achieved with the present emulsion.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion consisting essentially of silver halide grains which have a silver chloride content of at least 60 mol % and an octatetracontahedral crystal form constructed of 48 triangular faces, every one of which contacts convexly with each of two of its adjoining faces to form a line and concavely with the one remaining adjoining face to form a line.

2. The silver halide photographic emulsion of claim 1, which additionally contains a methine dye.

3. The silver halide photographic emulsion of claim 2, wherein said methine dye is present in an amount of from $4\times10^{-6}$ to $8\times10^{-3}$ mole per mole of silver halide.

4. The silver halide photographic emulsion of claim 1, which additionally contains a thiocyanate.

5. The silver halide photographic emulsion of claim 2, which additionally contains a thiocyanate.

6. The silver halide photographic emulsion of claim 4, wherein said thiocyanate is present in an amount of from $10^{-5}$ to $10^{-1}$ mole per mole of silver halide.

7. The silver halide photographic emulsion of claim 5, wherein said thiocyanate is present in an amount of from $10^{-5}$ to $10^{-1}$ mole per mole of silver halide.

* * * * *